US009649871B2

(12) United States Patent
Bargir et al.

(10) Patent No.: US 9,649,871 B2
(45) Date of Patent: May 16, 2017

(54) SECURITY ELEMENTS, AND METHODS AND APPARATUS FOR THEIR MANUFACTURE

(71) Applicant: DE LA RUE INTERNATIONAL LIMITED, Viables, Basingstoke (GB)

(72) Inventors: Sameer Mohammed Bargir, Coventry (GB); Paul Howland, Andover (GB)

(73) Assignee: DE LA RUE INTERNATIONAL LIMITED, Hampshire (GB)

( * ) Notice: Subject to any disclaimer, the term of this patent is extended or adjusted under 35 U.S.C. 154(b) by 0 days.

(21) Appl. No.: 14/971,443

(22) Filed: Dec. 16, 2015

(65) Prior Publication Data

US 2016/0101644 A1 Apr. 14, 2016

Related U.S. Application Data

(62) Division of application No. 13/522,209, filed as application No. PCT/GB2011/050134 on Jan. 28, 2011, now Pat. No. 9,248,637.

(30) Foreign Application Priority Data

Feb. 1, 2010 (GB) ..... 1001603.8

(51) Int. Cl.
*B42D 25/00* (2014.01)
*B42D 25/369* (2014.01)
(Continued)

(52) U.S. Cl.
CPC ..... *B42D 25/369* (2014.10); *B05D 3/207* (2013.01); *B41F 11/02* (2013.01); *B41M 3/14* (2013.01);
(Continued)

(58) Field of Classification Search
None
See application file for complete search history.

(56) References Cited

U.S. PATENT DOCUMENTS 4,388,131 A 6/1983 Unger et al.
4,838,648 A 6/1989 Phillips et al.
(Continued)

FOREIGN PATENT DOCUMENTS

EP 0 059 056 A1 9/1982
EP 0 686 675 A1 12/1995
(Continued)

OTHER PUBLICATIONS

Abstract Translation of US 2006-0198998 A1 (pub. 2006).*
(Continued)

*Primary Examiner* — Kevin Bernatz
(74) *Attorney, Agent, or Firm* — Oliff PLC

(57) ABSTRACT

An apparatus is provided for magnetically imprinting indicia into a layer on an article, the layer comprising a composition in which magnetic or magnetisable particles are suspended. The apparatus comprises: a soft magnetisable sheet, having an outer surface arranged to face the article in use, and an opposing interior surface; and a permanent magnet, shaped such that its magnetic field contains perturbations giving rise to indicia. The permanent magnet is disposed adjacent the interior surface of the soft magnetisable sheet. The soft magnetisable sheet enhances the perturbations of the magnetic field of the permanent magnet such that when the layer to be imprinted is located adjacent the outer surface of the soft magnetisable sheet, the magnetic or magnetisable particles are oriented by the magnetic field to display the indicia.

21 Claims, 12 Drawing Sheets

(51) Int. Cl.

| | |
|---|---|
| ***B41F 11/02*** | (2006.01) |
| ***B41M 3/14*** | (2006.01) |
| ***B42D 25/29*** | (2014.01) |
| ***B05D 3/00*** | (2006.01) |
| ***B42D 25/355*** | (2014.01) |

(52) U.S. Cl.

CPC ..... *B42D 25/00* (2014.10); *B42D 25/29* (2014.10); *B42D 25/355* (2014.10); *B42D 2033/16* (2013.01); *Y10T 428/24* (2015.01); *Y10T 428/24802* (2015.01)

(56) References Cited

U.S. PATENT DOCUMENTS

| | | | | |
|---|---|---|---|---|
| 5,630,877 | A | 5/1997 | Kashiwagi et al. | |
| 5,938,570 | A | 8/1999 | Maresh | |
| 6,062,140 | A | 5/2000 | McEachern | |
| 6,089,614 | A | 7/2000 | Howland et al. | |
| 6,428,051 | B1 | 8/2002 | Herrmann et al. | |
| 6,454,686 | B1 | 9/2002 | McEachern | |
| 6,759,097 | B2 | 7/2004 | Phillips et al. | |
| 7,487,908 | B1 | 2/2009 | Cook, Jr. et al. | |
| 7,517,578 | B2 * | 4/2009 | Raksha | B05D 3/207 283/72 |
| 7,934,451 | B2 | 5/2011 | Raksha et al. | |
| 8,137,762 | B2 | 3/2012 | Raksha et al. | |
| 8,813,644 | B2 | 8/2014 | Gygi et al. | |
| 2002/0182383 | A1 | 12/2002 | Phillips et al. | |
| 2004/0051297 | A1 | 3/2004 | Raksha et al. | |
| 2004/0228171 | A1 | 11/2004 | Ho et al. | |
| 2005/0106367 | A1 | 5/2005 | Raksha et al. | |
| 2005/0224203 | A1 | 10/2005 | Boehm et al. | |
| 2006/0097515 | A1 | 5/2006 | Raksha et al. | |
| 2006/0150854 | A1 | 7/2006 | Benninger et al. | |
| 2006/0198998 | A1 * | 9/2006 | Raksha | G02B 5/09 428/323 |
| 2006/0204724 | A1 | 9/2006 | Argoitia et al. | |
| 2007/0172261 | A1 | 7/2007 | Raksha et al. | |
| 2008/0054623 | A1 | 3/2008 | Kittler et al. | |
| 2008/0169640 | A1 * | 7/2008 | Scheir | B32B 37/12 283/94 |
| 2008/0171144 | A1 * | 7/2008 | Raksha | B41M 3/005 427/162 |
| 2008/0213516 | A1 * | 9/2008 | Wild | B05D 5/065 428/29 |
| 2010/0040845 | A1 * | 2/2010 | Schmid | B05D 3/207 428/207 |
| 2011/0017081 | A1 * | 1/2011 | Gygi | B41F 15/0804 101/129 |
| 2014/0077485 | A1 * | 3/2014 | Raksha | B41M 7/0072 283/67 |

FOREIGN PATENT DOCUMENTS

| | | | | |
|---|---|---|---|---|
| EP | 0 860 298 | A2 | 8/1998 | |
| EP | 1 674 282 | A2 | 6/2006 | |
| EP | 1674282 | A2 * | 6/2006 | B05D 3/207 |
| EP | 1 710 756 | A1 | 10/2006 | |
| EP | 1710756 | A1 * | 10/2006 | G02B 5/09 |
| EP | 1 745 940 | A2 | 1/2007 | |
| EP | 1 810 756 | A2 | 7/2007 | |
| EP | 1 990 208 | A1 | 11/2008 | |
| GB | 2 042 979 | A | 10/1980 | |
| JP | S58-111048 | A | 7/1983 | |
| WO | 00/39391 | A1 | 7/2000 | |
| WO | 02/073250 | A2 | 9/2002 | |
| WO | 02/090002 | A2 | 11/2002 | |
| WO | 03/000801 | A2 | 1/2003 | |
| WO | 03/040466 | A2 | 5/2003 | |
| WO | 03/054297 | A2 | 7/2003 | |
| WO | 03/095188 | A2 | 11/2003 | |
| WO | 2004/007095 | A2 | 1/2004 | |
| WO | 2004/050990 | A1 | 6/2004 | |
| WO | 2004/050991 | A1 | 6/2004 | |
| WO | 2005/002866 | A1 | 1/2005 | |
| WO | 2006/061301 | A1 | 6/2006 | |
| WO | 2006/069218 | A2 | 6/2006 | |
| WO | 2008/046702 | A1 | 4/2008 | |
| WO | 2008/139373 | A1 | 11/2008 | |
| WO | 2009/033601 | A1 | 3/2009 | |
| WO | 2010/058026 | A2 | 5/2010 | |
| WO | 2010/139930 | A1 | 12/2010 | |

OTHER PUBLICATIONS

Abstract Translation of U.S. Pat. No. 7,517,578 B2 (orig. pub. 2005).*

Aug. 22, 2011 International Search Report issued in International Application No. PCT/GB2011/050134.

Aug. 22, 2011 Written Opinion of the International Searching Authority issued in International Application No. PCT/GB2011/050134.

* cited by examiner

SECURITY ELEMENTS, AND METHODS AND APPARATUS FOR THEIR MANUFACTURE

This application is a divisional application of U.S. patent application Ser. No. 13/522,209, filed Oct. 3, 2012, which is a national stage of PCT/GB11/50134, filed Jan. 28, 2011, which claims priority to GB 1001603.8, filed Feb. 1, 2010. The disclosures of each are hereby incorporated by reference in their entireties.

This invention relates to security elements for articles such as documents of value including banknotes and the like, as well as methods and apparatus for their manufacture.

Documents of value, such as banknotes, passports, licences, certificates, cheques and identification documents, are frequently the target of counterfeiters and as such it is important to be able to test their authenticity. For this reason, such documents are provided with security features which are designed to be very difficult to reproduce fraudulently. In particular, the feature should not be able to be reproduced using a photocopier, for example. Well known features used for this purpose include security printing such as intaglio, security inserts such as magnetic threads, watermarks and the like. Also well known as security elements are optically variable devices such as holograms, colour shifting inks, liquid crystal materials and embossed diffractive or reflective structures, which may be applied as printed devices, embossings, patches, stripes, threads and more recently as wide embedded or applied tapes. Optically variable devices present a different appearance depending on the viewing conditions (e.g. angle of view) and are therefore well suited for use in authentication.

To be successful as a security device, the variable optical effect displayed by a device must be clearly and unambiguously detectable to a viewer, and difficult if not impossible for a counterfeiter to replicate, or produce an approximation to, by conventional means. If the optical effect is indistinct, or not particularly apparent to the observer, the device will be ineffective since a user will find it difficult to distinguish a genuine element from a counterfeit designed to have a similar general appearance but without the variable nature of the authentic effect (e.g. a high quality colour photocopy).

One type of optically variable device described in the literature makes use of oriented magnetic pigments to generate dynamic and three-dimensional like images. Examples of the related art describing such features include EP-A-1674282, WO-A-02/090002, US-A-20040051297, US-A-20050106367, WO-A-2004007095, WO-A-2006069218, EP-A-1745940, EP-A-1710756, WO-A-2008/046702 and WO-A-2009/033601. Typically the magnetic pigments are aligned with a magnetic field after applying the pigment to a surface. Magnetic flakes dispersed in a liquid organic medium orient themselves parallel to the magnetic field lines, tilting from the original planar orientation. This tilt varies from perpendicular to the surface of a substrate to the original orientation, which includes flakes essentially parallel to the surface of the product. The planar oriented flakes reflect incident light back to the viewer, while the reoriented flakes do not, providing the appearance of a three dimensional pattern in the coating.

WO-A-2004007095 describes the creation of a dynamic optically variable effect known as the "rolling-bar" feature. The "rolling-bar" feature provides the optical illusion of movement to images comprised of magnetically aligned pigment flakes. The flakes are aligned in an arching pattern relative to a surface of the substrate so as to create a contrasting bar across the image appearing between a first adjacent field and a second adjacent field, the contrasting bar appearing to move as the image is tilted relative to a viewing angle. The use of such kinematical images is developed further in EP-A-1674282 wherein the flakes are aligned in either a first or second arching pattern creating first and second contrasting bars which appear to move in different directions simultaneously as the image is tilted relative to a viewing angle. EP-A-1674282 also describes the creation of other rolling objects such as rolling hemispheres.

WO-A-2005/002866 and WO-A-2008/046702 each disclose apparatus and method for orientating magnetic particles in a layer so as to display indicia. In both cases, the indicia to be displayed are configured by providing a layer of permanent magnetic material with engravings in its surface. The engravings give rise to perturbations in the field emitted by the material and, when the layer containing the magnetic particles is placed within the field, the particles take on corresponding orientations. In practice, only certain magnetic materials are suitable for machining to produce the necessary engravings and typically a flexible polymer-bonded composite containing a permanent-magnetic powder such as Tromaflex™ by Max Baermann GmbH is used. Such materials have a relatively low magnetic strength, compared with conventional, brittle, ferrite magnets. As such, the degree of particle reorientation achieved by such an arrangement is low and the resulting optical effect is weak, both in terms of the magnetic indicia appearing indistinct and the 3 dimensional nature of the image—which leads to the illusion of movement—not being particularly apparent to the observer. In WO-A-2008/046702, the optical effect is improved to an extent by the provision of one or more additional permanent magnets positioned behind the engraved magnetic layer, which add to the magnetic field experienced by the magnetic particle layer. These may take the form, for example, of a series of bar magnets. However, the additional magnets must be located in a position spaced from the engraved magnetic layer so as not to destroy the inherent magnetism of the engraved layer. As such, the overall improvement to the magnetic field strength is not great, and the resulting optical effect remains indistinct. This is particularly the case when the security element is compared with the effects achievable with known holographic and lenticular devices.

EP-A-1710756 also discloses security elements comprising magnetic flakes orientated to produce an optical effect such as images of funnels, domes and cones, using various arrangements of permanent magnets to produce the magnetic field. However, the visual results achieved are not particularly distinct, and the shapes of images achieved is limited.

There is therefore a need for security elements of this sort which bear optical effects which are more distinct and therefore recognisable to an observer, in order to improve the ability to authenticate the security element.

In accordance with a first aspect of the present invention, an apparatus for magnetically imprinting indicia into a layer on an article is provided, the layer comprising a composition in which magnetic or magnetisable particles are suspended, the apparatus comprising: a soft magnetisable sheet, having an outer surface arranged to face the article in use, and an opposing interior surface; and a permanent magnet, shaped such that its magnetic field contains perturbations giving rise to indicia, the permanent magnet being disposed adjacent the interior surface of the soft magnetisable sheet, whereby the soft magnetisable sheet enhances the perturbations of the magnetic field of the permanent magnet such that when the layer to be imprinted is located adjacent the outer surface of the soft magnetisable sheet, the magnetic or magnetisable particles are oriented by the magnetic field to display the indicia.

"Soft" magnetisable materials are non-permanent magnets and typically have a low coercivity, at least when compared with permanent magnets. For example, in the absence of an applied magnetic field, a soft magnetisable material typically does not give rise to any significant magnetic field itself, at least externally.

By providing a soft (in the magnetic sense, rather than physical) magnetisable sheet between the permanent magnet and the layer to be imprinted, a number of advantages are achieved. Firstly, since the permanent magnet can be arranged close to or in contact with the soft magnetisable sheet to no detriment, in use, the permanent magnet can approach the layer to be imprinted much more closely, preferably spaced only by the magnetisable sheet itself. Since magnetic field strength decreases with radial distance from a magnetic source according to $r^3$, this ensures that the layer being imprinted experiences, as near as practicable, the full magnetic strength of the magnet. In addition, the soft magnetisable layer accentuates the perturbations in the field by virtue of its inherent high magnetic permeability (compared to the surrounding air). As such the magnetic field lines are "accelerated" through the thickness of the sheet, resulting in the field becoming focussed or concentrated in the immediate vicinity of the permanent magnet. In the region adjacent the outer surface of the sheet, where the magnetic particle layer will be placed in use, the curvature of the perturbations is enhanced, as is the local flux density (and hence magnetic field strength). Finally, the apparatus lends itself to the use of conventional, high flux density permanent magnetic materials since no machining is required. The result is a very high degree of particle realignment, which is concentrated into the vicinity of the permanent magnet. This leads to a very sharp and well defined visual appearance of the indicia displayed by the layer which is highly distinctive and recognisable to a viewer, thus improving the ability to distinguish the element and enhancing its function as an authenticator.

The permanent magnet can be provided in a variety of shapes depending on the indicia desired. Since the field produced by the magnet is localised by the magnetisable sheet, the magnet configuration will have a direct and significant effect on the resulting indicia (although there may not be a precise match). Particularly preferred magnet arrangements have been found to give rise to a strong 3-dimensional effect in the imprinted image, with the indicia clearly appearing to have "depth" and to move relative to the layer when the layer is tilted. For a particularly strong 3-dimensional appearance, preferably the permanent magnet should have an upper surface (facing the soft magnetisable sheet) with a profile which does not conform to that of the sheet. For example, at least part of the upper surface of the permanent magnet may be curved or sloped relative to the sheet. A spherical or hemispherical magnet is a particularly preferred example. Such curved or "tapered" magnets, used in combination with the soft magnetisable sheet as described above, have been found to produce a gradual (rather than sudden) change in particle angle over lateral distance in the layer being imprinted, which gives rise to the 3-dimensional appearance. The magnet is preferably in contact with the sheet at at least one point (and hence spaced from the sheet at others, due to its tapered profile), to minimise the spacing between the magnet and the particles.

However, it has also be found possible to achieve the gradual particle angle change and hence the 3-dimensional effect using a "flat" permanent magnet (the upper surface of which conforms to the inner surface of the sheet) provided the flat magnet is spaced from the sheet by a small amount. The spacing may be achieved, for example, by providing a non-magnetic spacing material between the magnet and the sheet (such as a plastic), or by use of a housing designed to hold the magnet in spaced relation from the sheet. No magnetic or magnetisable material should be present between the magnet and the sheet. In other preferred embodiments, therefore, the permanent magnet has an upper surface facing the soft magnetisable sheet, the profile of which substantially conforms to that of the sheet, and wherein the upper surface of the permanent magnet is spaced from the interior surface of the sheet by between 0.5 and 10 mm, preferably between 1 and 5 mm.

So that maximum field focussing is achieved, it is preferred that the lateral periphery of the permanent magnet in a plane perpendicular to the sheet's normal is within that of the sheet. In particularly preferred cases, the (minimum) lateral dimensions of the sheet are at least 1.5 times, preferably at least twice, those of the permanent magnet. Advantageously, the permanent magnet is shaped such that its lateral periphery has the form of indicia, preferably a geometric shape, symbol, alphanumeric letter or digit. Typically, the concentrated magnetic field will have regions of maximum curvature approximately aligned with the peripheral extremes of the magnet (provided these are not spaced too far from the magnetisable sheet) and so this can lead to formation of the same shape in the final displayed indicia. In particularly preferred examples, the permanent magnet is substantially spherical, dome-shaped or pyramidal. Advantageously the permanent magnet is arranged such that the axis defined between its north and south magnetic poles is substantially perpendicular to the sheet. In general it is preferred that the permanent magnet is shaped such that, in the vicinity of the sheet, the direction of the magnetic field changes between the centre of the permanent magnet and its lateral periphery. The lateral dimensions of the permanent magnet can be selected as appropriate for the desired indicia but in advantageous embodiments are between 5 and 50 mm, preferably 5 to 20 mm, more preferably 5-10 mm, still preferably 8 to 9 mm. More than one permanent magnet may also be provided to give rise to the indicia.

As mentioned above, it is preferred that permanent magnet contacts the sheet at at least one point, particular where the magnet is of a curved or tapered upper profile. This leads to the minimum separation between the magnet and the particle layer during imprinting. However, a narrow spacing layer may be included if desired, e.g. to fix the magnet in position—though preferably this would be formed of non-magnetic material.

In order to achieve a high level of particle alignment, a strong magnetic field is highly desirable. As such, in preferred embodiments, the permanent magnet has a magnetic remanence of at least 3000 Gauss, preferably at least 8000 Gauss, more preferably at least 10000 Gauss, most preferably at least 12000 Gauss. Any permanently magnetic material exhibiting such properties may be used, but in preferred examples, the permanent magnet comprises hard ferrite, samarium cobalt, AlNiCo or neodymium, preferably any of grades N33 to N52 neodymium.

To reduce the spacing between the magnet and the layer, and to prevent complete shielding of the magnetic field from the magnetic particle layer, the soft, magnetisable sheet is preferably configured to be as thin as practicable (in the direction parallel to the sheet's normal). Advantageously, the soft magnetisable sheet has a thickness less than 5 mm, preferably less than 2 mm, more preferably less than or equal to 1 mm, still preferably less than or equal to 0.5 mm, most preferably less than or equal to 0.25 mm. In practice, a minimum thickness of around 0.01 mm, more preferably 0.05 mm may be suitable. The soft magnetisable sheet is preferably of substantially uniform thickness, at least in the region of the permanent magnet. In preferred implementations, the soft magnetisable sheet is curved in at least one direction, its interior surface facing the interior of the curve. This enables the sheet to lie flush with the surface of a roller in which the apparatus is mounted.

The soft magnetisable sheet should preferably have as low a coercivity (and, correspondingly, magnetic remanence) as possible—ideally, zero—in order that it responds linearly to the magnetic field of the permanent magnet and does not impose any conflicting magnetic field. The coercivity of the soft magnetisable sheet is preferably lower than that of the permanent magnet. Advantageously, the sheet has a coercivity of less than or equal to 25 Oe, preferably less than or equal to 12 Oe, more preferably less than or equal to 1 Oe, still preferably less than or equal to 0.1 Oe, most preferably between 0.01 and 0.02 Oe (1 A/m=0.012566371 Oe).

To achieve a high degree of field concentration, the sheet should also preferably be of a high magnetic permeability. In preferred examples, the soft magnetisable sheet has a relative magnetic permeability at a magnetic flux density of 0.002 Tesla of greater than or equal to 100, preferably greater than or equal to 500, more preferably greater than or equal to 1000, still preferably greater than or equal to 4000, most preferably greater than or equal to 8000. Any suitable soft magnetic material could be used for the soft magnetisable sheet, preferably permalloy, ferrite, nickel, steel, electrical steel, iron, Mu-metal or supermalloy.

Preferably, the magnetic properties of the soft magnetisable sheet are substantially uniform across the sheet, at least in the region of the permanent magnet.

The apparatus could be mounted in any convenient way. However, in a preferred implementation, the apparatus further comprises a housing configured to support the permanent magnet(s) and soft magnetisable sheet in fixed relation to one another, the housing having an upper surface arranged to face the article in use, one or more recesses being provided in the upper surface in which the permanent magnet(s) is/are accommodated, the soft magnetisable sheet being mounted on the upper surface of the housing and covering the one or more recesses. This arrangement ensures that the permanent magnet is held in close proximity to the outermost surface of the assembly and hence approaches the layer to be imprinted closely during use. Preferably, the or each recess wholly accommodates the permanent magnet(s) such that the soft magnetisable sheet lies flush over the recess(es). Advantageously, the soft magnetisable sheet is mounted to the upper surface of the housing via an adhesive layer, or an adhesive tape disposed over the soft magnetisable sheet and adjoining the housing. Preferably, the upper surface of the housing is curved in at least one direction, for use in a roller assembly.

Also provided is an imprinting assembly comprising an array of apparatus, each as described above. This may take the form of a flat plate, but preferably the assembly is formed in the surface of a roller.

A second aspect of the present invention provides a method of manufacturing a security element, comprising: providing a layer comprising a composition in which magnetic or magnetisable particles are suspended; bringing the layer into proximity with the outer surface of the soft magnetisable sheet of an apparatus according to the first aspect of the present invention so as to orientate the magnetic or magnetisable particles to display indicia; and hardening the layer so as to fix the orientation of the magnetic or magnetisable particles such that the indicia are permanently displayed.

This manufacturing technique results in a security element displaying a highly distinct and recognisable optical effect, for all the reasons previously described.

The layer containing the magnetic particles could be formed in a previous, separate procedure and supplied ready for magnetic imprinting. In preferred cases, the layer is provided by printing or coating the composition onto a substrate, preferably by screen printing, rotary silkscreen printing, gravure or reverse gravure. This may be a sheet-fed or web-fed technique.

So that the optical effect produced can be fully viewed, it is preferable that at least one of the lateral dimensions of the layer is larger than the corresponding lateral dimension of the permanent magnet, such that the displayed indicia are within the periphery of the layer. However, it has been found that, for the best effect, the indicia should not appear too far from the periphery of the layer, so that the apparent movement of the indicia is accentuated by the stationary periphery. Therefore, preferably, the layer is placed adjacent the outer surface of the soft magnetisable sheet in a position whereby a periphery of the layer is laterally displaced from the nearest lateral periphery of the permanent magnet by between 0.5 and 2 cm, preferably between 0.5 and 1.5 cm, more preferably between 0.5 and 1 cm. In order that the indicia appears in reasonable proximity to each side of the periphery, in preferred cases, the layer has a lateral dimension between 1.25 and 5 times greater than that of the permanent magnet, preferably between 1.25 and 3 times greater than that of the permanent magnet, still preferably between 1.25 and 2 times greater than that of the permanent magnet.

To further enhance the appearance of 3-dimensional movement, in preferred embodiments, the layer is provided with one or more registration features (or "datum" features) against which the position of the indicia displayed by the layer may be judged, the registration features preferably comprising gaps in the layer and/or formations in the periphery of the layer. There is also an additional effect achieved by the provision of datum features which is that the image defined by the oriented magnetic pigments can enhance the datum feature(s). For example, movement of the image can be arranged so as to appear to occur under the datum feature, thus highlighting the feature. This can be utilized in particular where a plurality of said datum features are arranged in a sequence, the effect exhibited by the magnetic layer being adapted to "move" past the datum features in a direction corresponding to a desired reading direction when the element is tilted.

In the case of gaps, preferably the magnetic layer is printed or coated so as to define the gaps. However, a continuous area of the material could be printed or coated first followed by selective removal to define the gaps. Methods for removal include laser ablation and chemical etching. Various additional effects can be achieved depending upon the material in the gaps. For example, if the substrate on which the element is provided is transparent then typically the datum feature is visible when viewed in transmission, offering a further secure aspect to the device. In another embodiment, the lateral dimensions of the gaps defining the datum feature(s) are sufficiently small that they are only visible in transmission and not readily apparent in reflection. In this case typical height and widths for the gaps are in the in the range 0.5 to 5 mm and more preferably 0.5 to 2 mm. On the other hand, if the security device is provided on a printed substrate then parts of the print will show through the gaps when viewed in reflection.

Advantageously, the registration feature is provided in the form of a V-shaped gap at the periphery of the layer, or as a series of periodic gaps formed along the periphery. In other preferred cases, a registration feature is provided (additionally or alternatively) in the form of a central gap in the layer, preferably a circular gap. This may not be in the geometric centre of the layer, but is surrounded on all sides by areas of the layer. The datum feature(s) can also be one or more of a symbol, alphanumeric character, geometric pattern and the like. Possible characters include those from non-Roman scripts of which examples include but are not limited to, Chinese, Japanese, Sanskrit and Arabic. In one example the datum feature could define a serial number of a banknote, or a word. In these latter cases, the optical effect defined by the oriented magnetic pigments can be arranged to appear to move along the word or serial number in the direction in which it is to be read when the element is tilted.

In other preferred implementations, the method may further comprise providing a registration or datum feature in the form of a marker applied to the layer, preferably by printing, coating or adhesion. The datum feature(s), when printed, can be printed using any suitable known technique including wet or dry lithographic printing, intaglio printing, letterpress printing, flexographic printing, screen-printing, inkjet printing and/or gravure printing. When the datum feature(s) is printed then typically this will occur as a second working with the oriented magnetic pigments being printed in a first working. This has the advantage that very fine line printed datum features can be provided. The datum feature(s) can be provided in a single colour or be multi-coloured. In the case of gaps, as mentioned above, the colours of the datum feature(s) can be determined based on the colour of the underlying substrate.

In particularly preferred embodiments, the substrate comprises paper sheet, polymer film or a composite thereof. For example, the layer may be formed directly on a security paper whereby the substrate comprises a document of value, preferably a banknote, passport, identity document, cheque, certificate, visa or licence, or as a thread or transfer film suitable for application to or incorporation in a document of value.

The layer composition preferably comprises a UV-curable fluid, an electron beam curable fluid or a heat-set curable fluid. The composition may include a coloured tint if desired. In preferred cases, the magnetic or magnetisable particles are non-spherical, preferably having at least one substantially planar surface, still preferably having an elongate shape and most preferably in the form of platelets or flakes. The magnetic or magnetisable particles may comprise uncoated magnetic flakes (such as nickel or iron) but in preferred embodiments, the magnetic or magnetisable particles comprise an optically variable structure whereby the particles reflect light having wavelengths within a first spectral band at a first angle of incidence, and light having wavelengths within a second, different spectral band at a second angle of incidence. This leads to the appearance of a colour shift in the security element which further enhances its distinctive and dynamic appearance as will be described further below. Advantageously, the optically variable structure is a thin film interference structure and, most preferably, the thin film interference structure incorporates magnetic or magnetisable material therewithin. Suitable particles of this sort are disclosed in WO-A-2008/046702 at page 8, lines 18 to 26 for example.

In preferred methods, the layer is hardened while the layer is in proximity with the outer surface of the soft magnetisable sheet, so that the orientation of the particles is maintained by the magnetic field until fixing is complete. However, this may not be necessary if the composition is sufficiently viscous to prevent realignment of the flakes once removed from the magnetic field (and no other magnetic field is applied prior to fixing). The hardening process will depend on the nature of the composition but in preferred cases this is carried out by physical drying, curing under UV irradiation, an electron beam, heat or IR irradiation.

In further examples the secure nature of the current invention can be extended further by the introduction of detectable materials within one of the existing layers or in an additional layer of the security elements. Detectable materials that react to an external stimulus include but are not limited to fluorescent, phosphorescent, infrared absorbing, thermochromic, photochromic, magnetic, electrochromic, conductive and piezochromic materials.

Further aspects of the invention provide security elements possessing particular novel characteristics providing specific improvements in the elements' ability to authenticate, as will be set out below. These aspects of the invention can be implemented using the apparatus and methods described above, but should not be considered limited to production via these manufacturing techniques.

In a third aspect of the present invention, a security element is provided comprising a layer disposed on a substrate, the layer comprising a composition having magnetic or magnetisable particles therein, each particle having at least one substantially planar surface, wherein the magnetic or magnetisable particles vary in orientation across the layer such that:

at a first part of the layer, the particles are orientated with their planar surfaces substantially parallel to the normal to the layer, the angle between the planar surfaces of the particles and the normal gradually increasing with increasing radial distance from the first part to a maximum of approximately 90 degrees at a first radial position of the layer before decreasing gradually again until a second, father, radial position of the layer, the normals to the planar surfaces of the particles disposed between the first part and the second radial position intersecting one another at points on a first side of the layer, and from the second radial position, the angle between the planar surfaces of the particles and the normal of the layer gradually increases with increasing radial distance, the normals to the planar surfaces of the particles intersecting one another at points on a second side of the layer, opposite to the first side, such that the security element displays a bright edge corresponding to the first radial position, between a first dark area which includes the first part of the layer, and a second dark area, at least when the security element is viewed along a direction substantially normal to the plane of the substrate.

This arrangement of the magnetic flakes has been found to result in a particularly sharp and distinct "edge" feature, appearing as a bright line in the element which contrasts clearly with the regions either side and has a strong 3-dimensional appearance in ambient light (such as daylight), resulting from the curvature of the flake alignment. The feature also exhibits a high degree of lateral movement when viewed at an angle (under any lighting conditions). The bright edge is cleanly defined between the first part of the layer, where the flakes are vertical and hence reflect very little light (if any) and the second radial position, in the vicinity of which the flakes once again are closely aligned with the normal to the element (i.e. near-vertical). Conventional security elements, in comparison, generally have so far only been able to achieve one reasonably sharp edge of a bright region, with little or no definition elsewhere in the element. In addition, the region outside the second radial position, where the angle of the flakes increases once more, provides an additional optical effect since, when the element is tilted so as to be viewed at an angle to its normal, parts of this region will appear bright and others dark, when viewed under ambient conditions. This provides the bright edge with a "background" which is dynamic rather than static.

At the second radial position, the planar surfaces of the particles are preferably substantially parallel to the normal of the layer.

In particularly preferred implementations, when viewed in daylight, the thickness of the bright edge between the contrasting dark areas is less than about 10 mm, preferably less than or equal to about 5 mm, more preferably between 1 and 4 mm, still preferably between 2 and 3 mm. In terms of the particle arrangement, it is preferred that the lateral distance between the first part of the layer and the second radial position is between 1 and 10 mm, preferably between 2 and 5 mm. Dimensions of this sort have been found to provide a good combination of brightness and resolution which makes the element highly recognisable.

For high definition of the edge, the rate of change of the particles' angle with radial distance should also be high immediately adjacent either side of the edge. In preferred cases, the orientation of the particles varies such that the angle between the planar surfaces of the particles and the normal changes between near zero and the maximum of approximately 90 degrees at the first radial position across a distance of less than or equal to 3 mm, preferably less than or equal to 2 mm, still preferably less than or equal to 1 mm, each side of the first radial position.

In any case, the rate of change of angle in these regions should preferably be greater than that outside the second radial position (where the angle is increasing). Indeed, it is preferred that, in the region of increasing angle between the planar surfaces of the particles and the normal to the layer outside the second radial position, the angle does not increase to substantially 90 degrees within the periphery of the layer. In this way, when viewed along its normal, the element will appear dark (at least darker than the bright edge) all the way between the edge and the periphery. However, in other implementations, it is preferred that the angle does not increase to substantially 90 degrees within at least 2 mm, preferably at least 3 mm, more preferably at least 5 mm, of the second radial position. This ensures a sufficient spacing between the bright edge and any other bright region of the element.

At the second radial position, the lower the angle between the particle's surface and the normal of the layer, the darker the region will appear. However, it is not vital that the angle reaches zero. In preferred embodiments, the angle between the planar surfaces of the particles and the normal to the layer decreases to an angle of less than 45 degrees at the second radial position, preferably less than 30 degrees, more preferably less than 10 degrees, still preferably around zero degrees.

The bright edge could take any desirable shape, such as a straight line or arc, but it has been found that edges formed into outlines or loops, complete or incomplete, are particularly distinctive, especially in view of the 3-dimensional appearance of the edge since the outline as a whole then appears to define some larger 3D object. In a particularly preferred embodiment, the variation of the particles' orientation is substantially the same along each radial direction such that the bright edge forms a circular outline, the first dark area being located within the outline and the second dark area being located outside the outline. In other advantageous examples, the variation of the particles' orientation along each radial direction is a function of angular position, such that the bright edge forms a non-circular outline, the first dark area being located within the outline and the second dark area being located outside the outline. For example, the outline could be square, rectangular, triangular or even irregular. The outline or edge can also include gaps, by arranging that, along selected radial direction(s) the particle orientation does not undergo any variation, remaining substantially parallel to the normal of the substrate, to thereby form one or more corresponding gaps in the bright edge.

For maximum optical impact, the edge should not be spaced too far from the periphery of the layer. Therefore, in preferred examples, the distance along the radial direction between the centre of the first part of the layer and the periphery of the layer is between 1.25 and 3 times the distance between the centre and the bright edge, preferably between 1.25 and 2 times, more preferably between 1.25 and 1.5 times. Advantageously, the first part of the layer is substantially centred on the lateral mid-point of the layer. However this need not be the case and in other examples the first part of the layer may be located on or adjacent a periphery of the layer.

The security element may be formed using standard magnetic particles, such as nickel flakes, in which case the appearance will be monochromatic, with the colour of the bright edge remaining constant irrespective of the angle of view. However, in preferred implementations, the appearance is further enhanced by the magnetic or magnetisable particles comprising an optically variable structure whereby the particles reflect light having wavelengths within a first spectral band at a first angle of incidence, and light having wavelengths within a second, different spectral band at a second angle of incidence. Such "OVMI" particles not only give the bright edge the ability to display different colours at different viewing angles but, importantly, imparts a further effect to the "background" region formed outside the second radial position. Since, here, the flakes lie at varying angles approaching flat, when the element is viewed at an angle (i.e. not along its normal), different portions of the background will appear as one colour, and other portions a second colour (the colours will be determined by the particular ink selected). The boundary between the two colours will appear to move as the element is tilted, giving rise to what is termed the "rolling bar" effect. Thus, the bright edge will appear against a "rolling bar" background, giving a particularly impressive visual impact and high authentication ability.

A further notable optical effect achieved by the security element, whether formed using OVMI particles or not, is that when illuminated by multiple light sources, a corresponding plurality of bright edges may be visible. In practice it has been found that this effect is more readily discernable where OVMI particles are used since the multiple edges appear better displaced from one another, e.g. by 1 to 2 mm. The two or more edges have the same shape as each other and, where the multiple light sources are diffuse (e.g. in a room having two or more ceiling lights), each edge displays 3D depth. When the element is tilted, the two edges move relative to one another which provides a particularly distinct, recognisable and easily testable security feature. Using OVMI particles, the two edges may also appear to be of different colours to one another, at least at some viewing angles, which makes the element stand out yet more.

Like security elements produced using the method of the second aspect of the invention, the security elements of the third aspect may preferably be provided with one or more registration features against which the position of the bright outlines may be judged, the registration features preferably comprising gaps in the layer and/or formations in the periphery of the layer. These can be configured in the same manner as described with respect to the second aspect, above.

A fourth aspect of the present invention provides a security element comprising a magnetic layer and a print layer disposed on a translucent substrate, the print layer being disposed between the magnetic layer and the substrate, wherein the magnetic layer comprises a composition having magnetic or magnetisable particles therein, each particle having at least one substantially planar surface, wherein the print layer includes printed authentication data and the magnetic or magnetisable particles are orientated such that in a region of the magnetic layer covering at least part of the authentication data, at least some of the magnetic or magnetisable particles are orientated with their planar surfaces substantially parallel to the plane of the substrate, such that the authentication data is substantially concealed when the security element is viewed in reflected light at least along the normal to the substrate, and wherein the printed authentication data is of sufficient optical density that the authentication data is visible through the region of the magnetic layer when viewed in transmitted light.

By aligning printed authorisation data with a region of the magnetic layer in which the magnetic particles are substantially parallel to the substrate, and arranging for the authorisation data to be visible in transmission through the same region, the security element provides for an additional, covert level of authentication in addition to the overt effect provided by the magnetic layer itself. During normal handling, the element will be seen under reflected light and the appearance of the magnetic layer—which is preferably designed to have a high visual impact—will dominate. This should at least be the case when the element is viewed along the normal to the substrate, but preferably is also the case when viewed from a range of angles, e.g. up to 60 degrees from the substrate normal in some cases, and 90 degrees (i.e. parallel to the substrate surface) in others. When the element is viewed in transmission, however, the hidden authorisation data will be revealed, thus providing a straightforward means of double-checking that the element is genuine. Neither the dynamic nature of the magnetic layer nor the hidden authorisation data underneath can be captured by copying the element and as such its security level is particularly high.

By "substantially parallel" to the substrate, it is meant that the particles' planar surfaces make a high angle with the substrate normal (90 degrees is the maximum possible, at which the particle's surface is orthogonal to the substrate normal). For instance, the angle between the particles' planar surfaces and the substrate normal is preferably at least 60 degrees, more preferably at least 70 degrees, still preferably at least 80 degrees and most preferably about 90 degrees (e.g. above 89 degrees).

By "covering" at least part of the authorisation data, it is meant that the said region of the magnetic layer lies directly over at least part of the authorisation data such that, when viewed by an observer (facing the side of the structure carrying the magnetic layer), the region of the magnetic layer sits between the observer and part of the authorisation data. The observer's view of that part of the authorisation data is obstructed by the region of the magnetic layer.

Preferably, so as best to conceal the authorisation data, in the region of the magnetic layer, a majority of the particles are orientated with their planar surfaces substantially parallel to the plane of the substrate. However, the region may also include particles arranged at other angles and this can be utilised to assist in concealing the data when the element is viewed at angles other than along its normal.

In an advantageous embodiment, in a first portion of the magnetic layer laterally adjacent to the region of the magnetic layer, at least some of the magnetic particles are oriented with their planar surfaces at a non-zero angle of less than 90 degrees with the plane of the substrate, the normals to the planar surfaces of the oriented particles in the first portion intersecting with the normals to the planar surfaces of the oriented particles in the region on the side of the particles adjacent the substrate. For example, immediately adjacent each side of the data, the particles may be angled such that their normals are arranged to point towards the data such that if the element is viewed from the side, the viewer will still be presented with the reflective faces of the particles in the region of the data, thus obscuring the view.

The magnetic layer could take any configuration including a continuous, bright layer with no significant change in the particle orientation (i.e. substantially horizontal particles are included across the layer). However, preferably, the orientation of the particles varies across the magnetic layer such that indicia are displayed by the layer. This increases the visual impact of the element and the difficulty of reproduction substantially.

The required optical density of the printed data will depend on the nature of the substrate and the optical density of the magnetic layer. The substrate is translucent (i.e. able to transmit some light), and could comprise for example paper, security paper, polymer or coated polymer or any combination thereof (e.g. as a multi-layer structure). To improve the visibility of the data in transmission, preferably the printed authentication data is printed in a dark colour, contrasting with the underlying substrate. The authorisation data can take any desirable form but preferably comprises one or more alphanumeric digits, symbols, graphics or patterns.

In particularly preferred implementations, the magnetic layer is configured as defined above in relation to the third aspect of the present invention, the resulting bright outline being aligned with the printed authorisation data. This achieves the combined benefits of a magnetic layer having a particularly distinct and recognisable optical effect with the provision of covert printed data as already described. Preferably, when the angle of viewing is changed, the bright region appears to move laterally, relative to the layer.

As in the above aspects, the element may be provided with one or more registration features to enhance the appearance of the magnetic indicia. The magnetic particles may also comprise optically variable structures as before.

In a fifth aspect of the invention, a method of making a security element is provided, comprising: printing a print layer including authorisation data onto a translucent substrate;

providing a magnetic layer comprising a composition in which magnetic or magnetisable particles, each having at least one substantially planar surface, are suspended over at least a portion of the print layer; imprinting in the magnetic layer by orientating the magnetic or magnetisable particles using a magnetic field, such that, in a region of the magnetic layer covering at least part of the authentication data, at least some of the magnetic or magnetisable particles are orientated with their planar surfaces substantially parallel to the plane of the substrate; hardening the layer so as to fix the orientation of the magnetic or magnetisable particles, wherein the authentication data is substantially concealed by the region of the magnetic layer when viewed in reflected light at least along the normal to the substrate, and wherein the printed authentication data is of sufficient optical density that the authentication data is visible through the bright region of the magnetic layer when viewed in transmitted light.

This method results in a security element having the advantages described above.

The print layer can be produced by any desirable technique but preferably is printed by lithographic printing, intaglio, screen printing, flexographic printing, letterpress printing, gravure printing, laser printing or inkjet printing. The magnetic indicia can be imprinted using any known technique, but in preferred implementations, this is accomplished using apparatus in accordance with the first aspect of the invention. The remaining steps of the method can also be implemented as described in relation to the second aspect of the present invention.

All of the security elements described above may be formed on articles such as documents of value or could be manufactured as transfer elements for later application to such articles. The present invention therefore also provides a transfer element comprising a security element as described above, disposed on a support substrate. The transfer element may preferably further comprise an adhesive layer for adhering the security element to an article and, optionally, a release layer between the security element and the support substrate. It is desirable that the optical effect of the magnetic layer of the security element is in some way registered to the design of the rest of the document onto which the device is applied.

The security element could be in the form of a stand alone device provided on a security document or other article but alternatively could be provided as an insert such as a security thread, arranged for example on a carrier such as PET. The device can also be provided as a patch or stripe. This construction option is similar to that of the thread construction, the exception being that the carrier layer is optionally provided with a release layer should it not be desirable to transfer the PET carrier to the finished document.

In a further embodiment of the invention, the device is incorporated into a secure document such that regions of the device are viewable from both sides of the document, preferably within a transparent window region of the document. Methods of incorporating a security device such that it is viewable from both sides of the document are described in EP-A-1141480 and WO-A-3054297. In the method described in EP-A-1141480 one side of the device is wholly exposed at one surface of the document in which it is partially embedded, and partially exposed in apertures at the other surface of the document. In the method described in EP-A-1141480 the carrier substrate for the device is preferably biaxially oriented polypropylene (BOPP) rather than PET.

Examples of apparatus for magnetically imprinting indicia, and methods of making security elements, as well as security elements, transfer elements and documents of value will now be described with reference to the accompanying drawings, in which:—

Figure 4A:
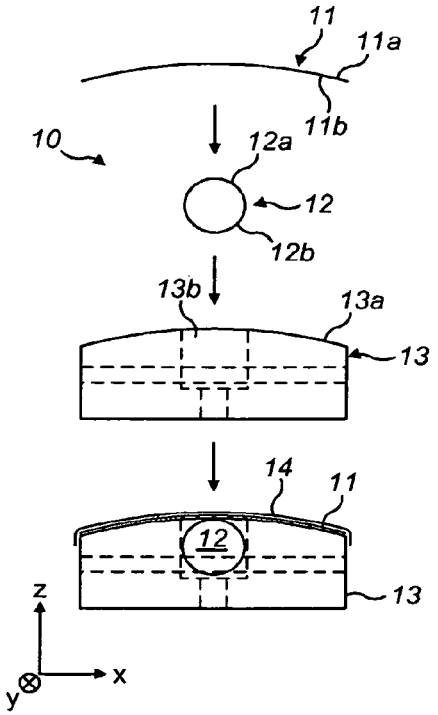
Figure 4B:
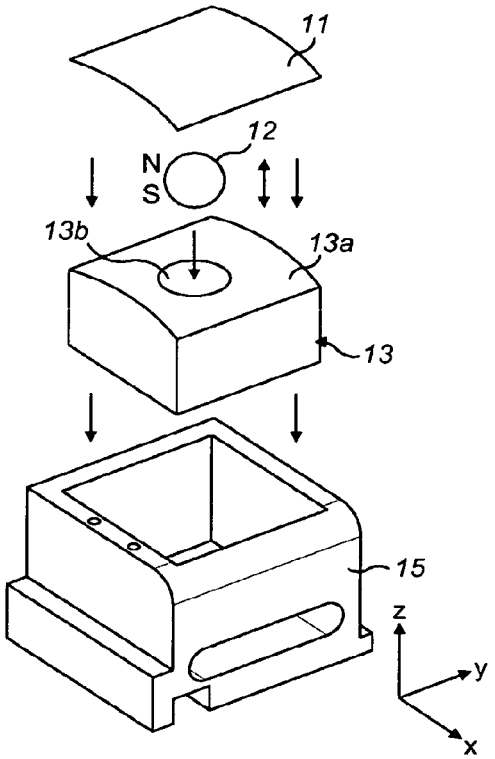
Figure 4C:
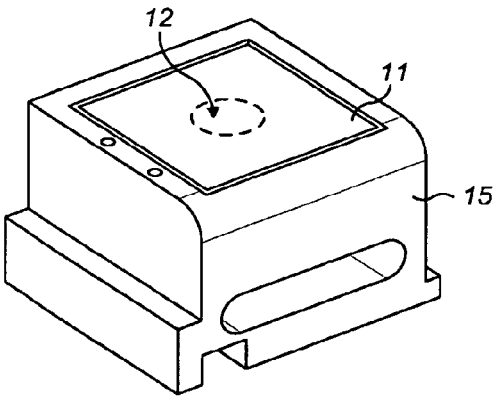
Figure 5A:
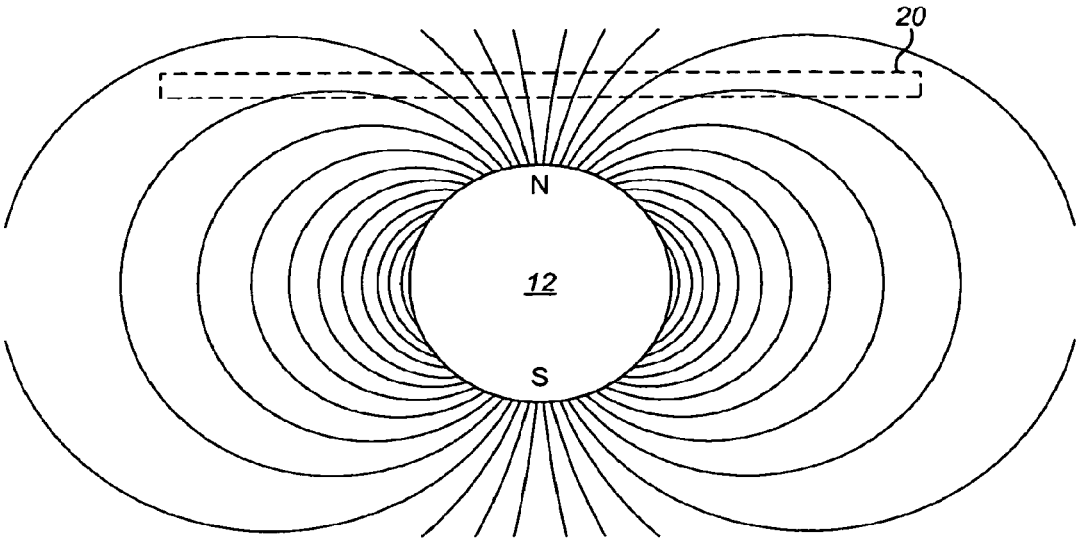
Figure 5B:
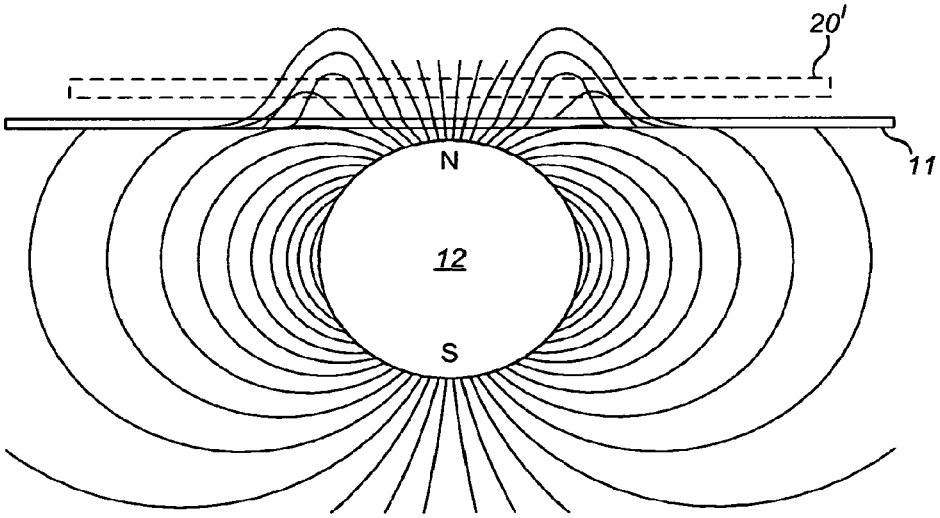
Figure 6A:
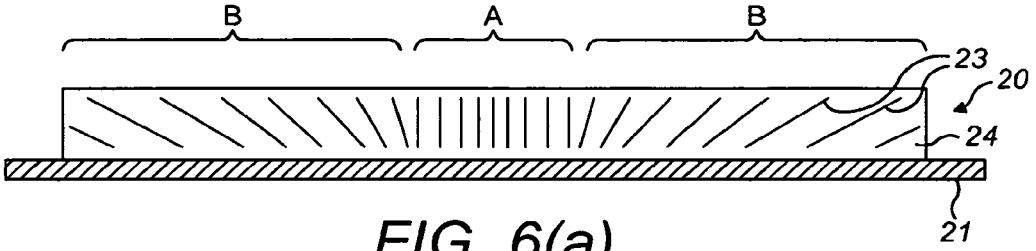
Figure 6B:
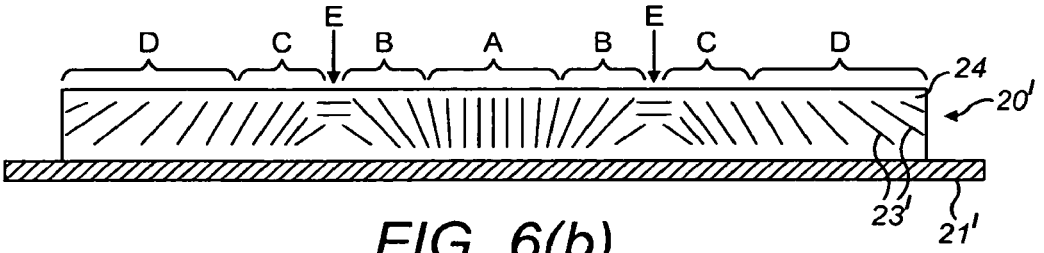
Figure 7A:
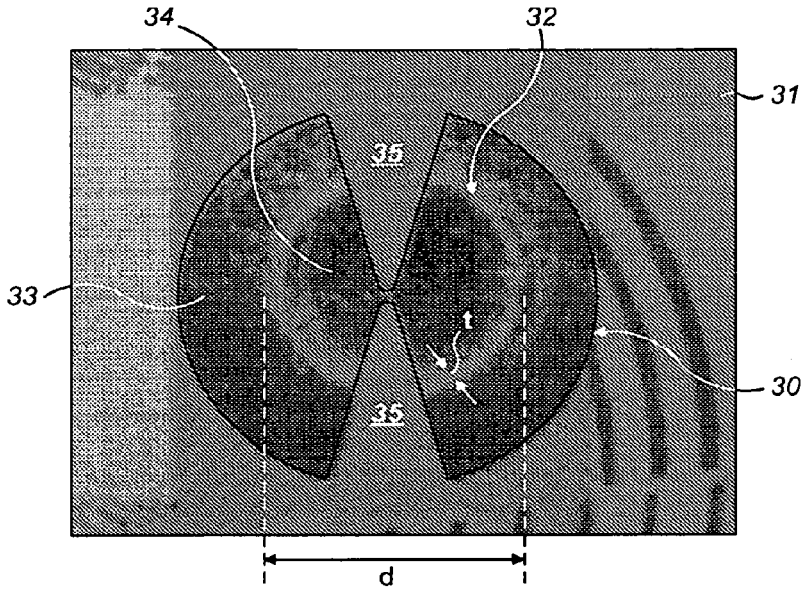
Figure 7B:
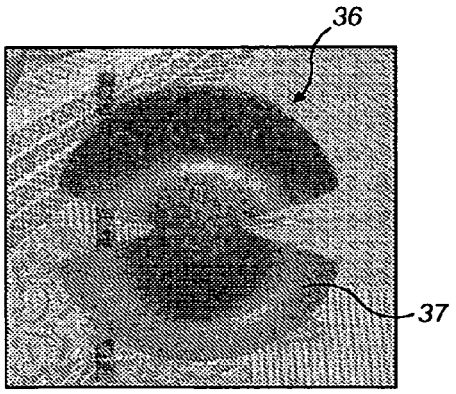
Figure 7C:
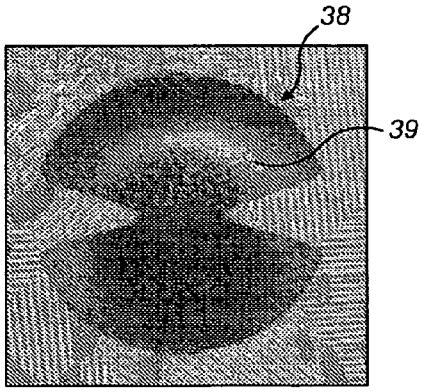
Figure 8:
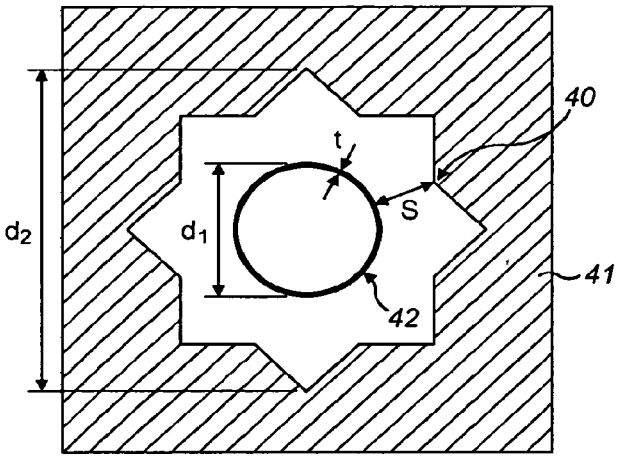
Figure 9A:
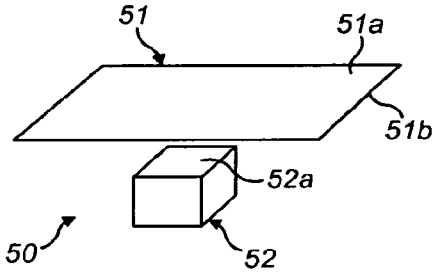
Figure 9B:
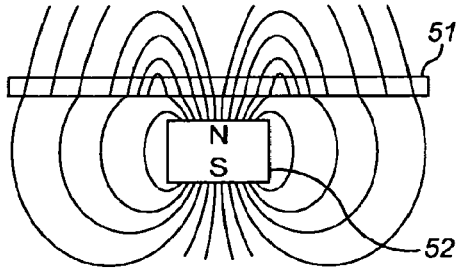
Figure 9C:
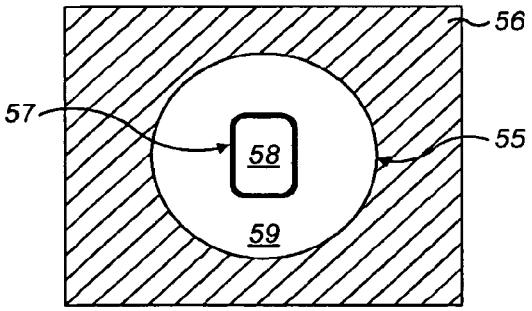
Figure 10A:
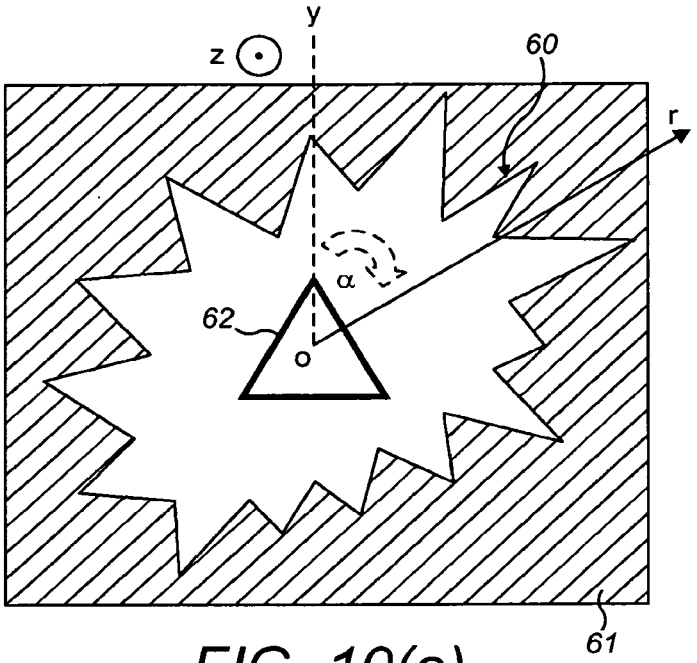
Figure 10B:
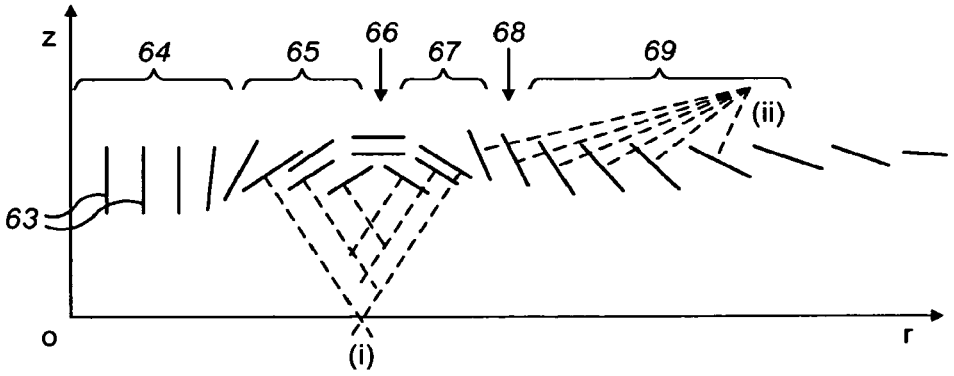
Figure 12:
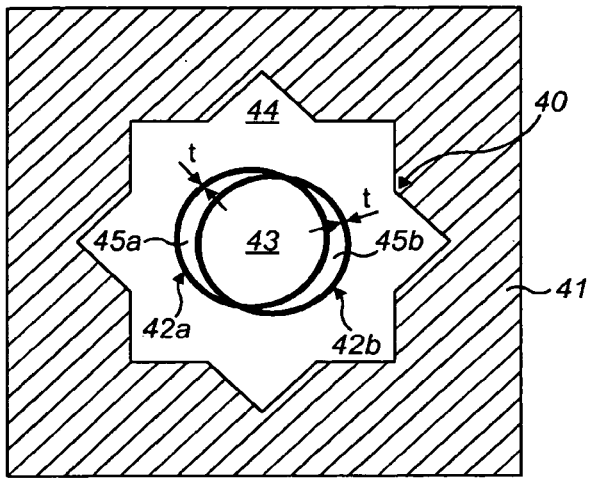
Figure 13A:
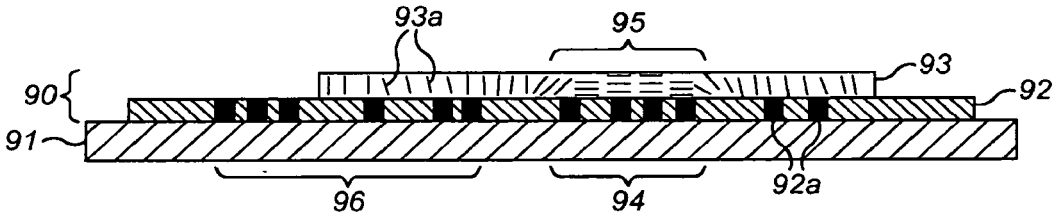
Figure 13B:
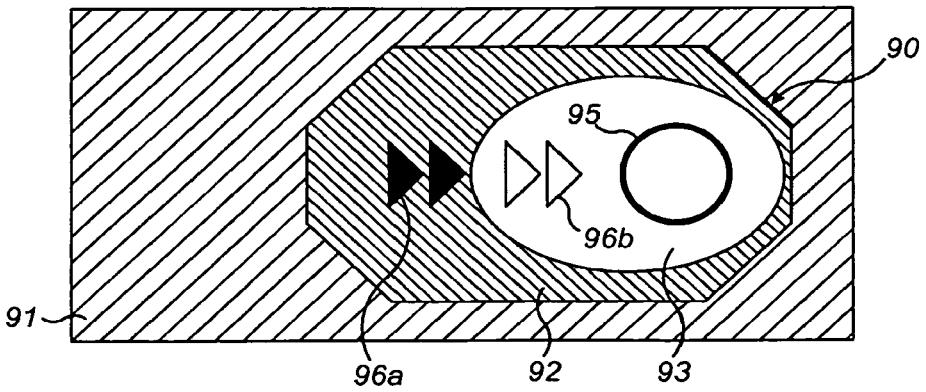
Figure 13C:
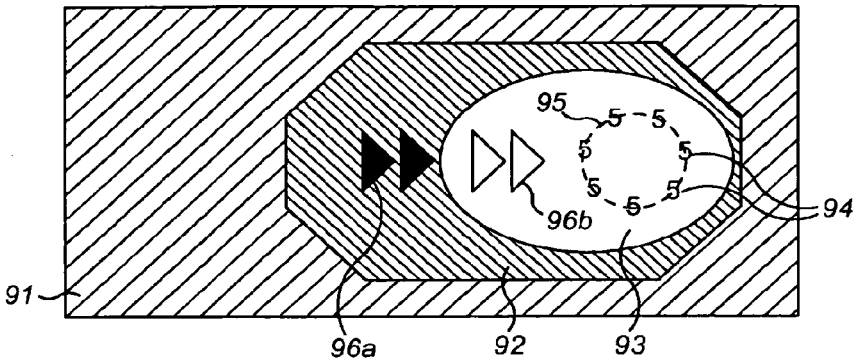
Figure 14A:
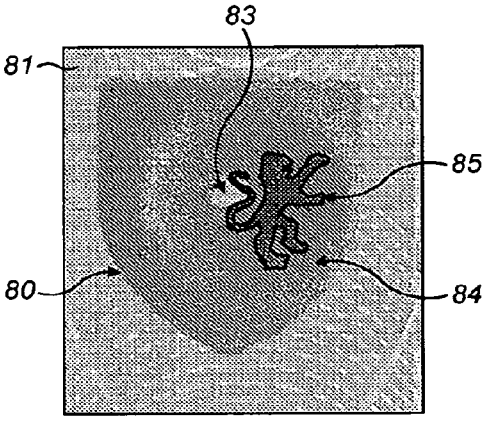
Figure 14B:
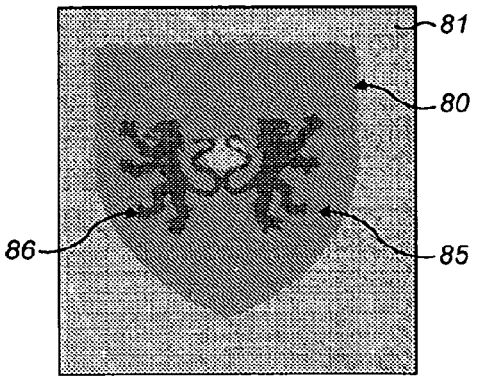
Figure 15:
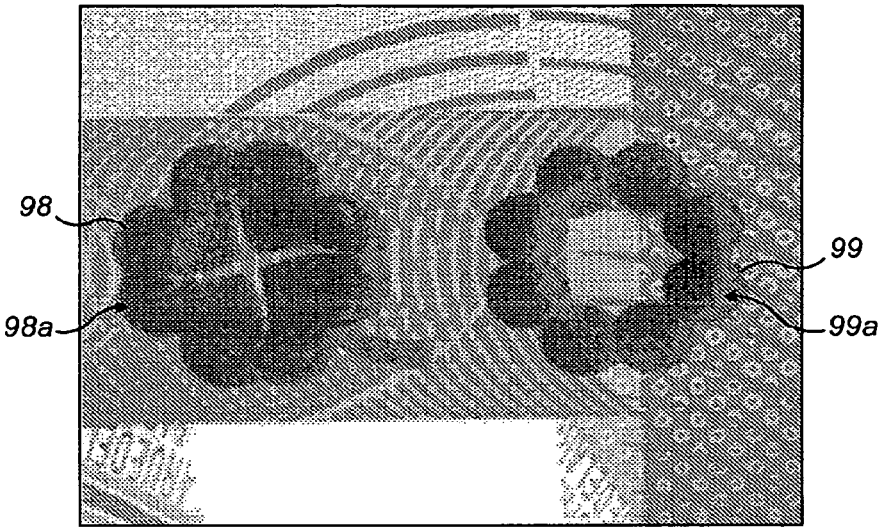
Figure 16:
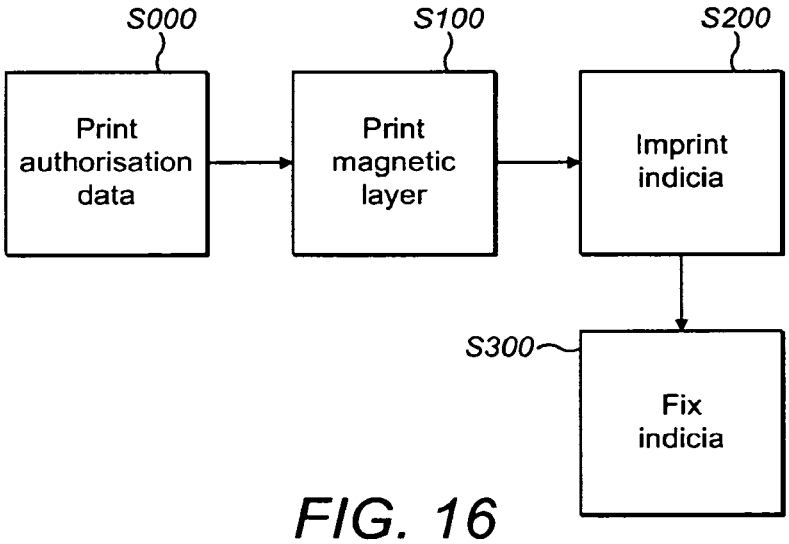
Figure 17A:
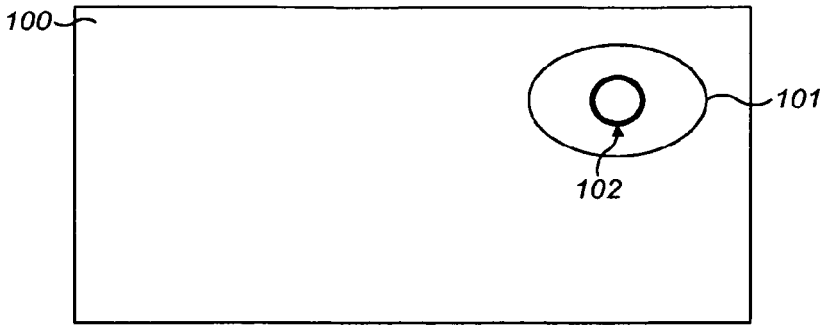
Figure 17B:
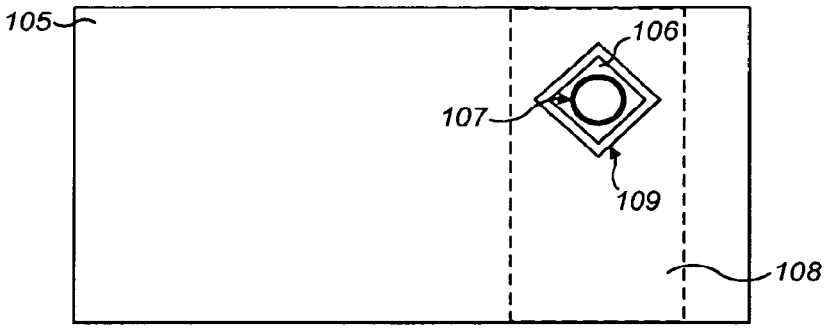
Figure 18A:
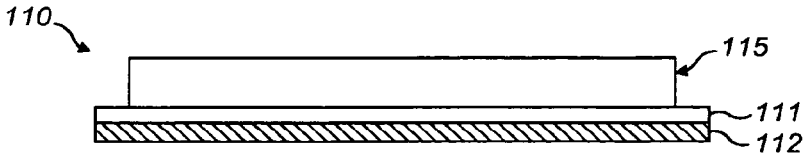
Figure 18B:
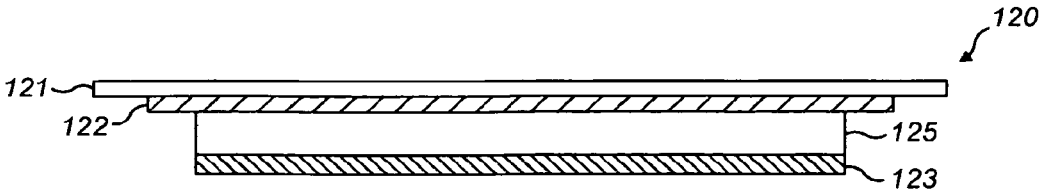

FIGS. 4*a*, 4*b* and 4*c* show a first embodiment of an apparatus for magnetically imprinting indicia: FIG. 4*a* showing the apparatus in an expanded, cross-sectional view, FIG. 4*b* showing the apparatus in an expanded, perspective view, and FIG. 4*c* showing the assembled apparatus in perspective view;

FIGS. 5*a* and 5*b* illustrate the magnetic field established by the apparatus of FIG. 4, FIG. 5*a* illustrating the field when the soft magnetisable sheet of the apparatus removed and FIG. 5*b* illustrating the field when the soft magnetisable sheet of the apparatus is in position, for comparison;

FIGS. 6*a* and 6*b* illustrate the orientation of the magnetic or magnetisable particles in a security element resulting from the magnetic fields of FIGS. 5*a* and 5*b* respectively;

FIGS. 7*a*, 7*b* and 7*c* show exemplary security elements, FIG. 7*a* showing a security element formed using the magnetic field of FIG. 5*b* viewed along the normal of the element, FIG. 7*b* showing a security element formed using the magnetic field of FIG. 5*b* viewed at an angle to the normal, and FIG. 7*c* showing a security element formed using the magnetic field of FIG. 5*a*, viewed at an angle, for comparison, the security elements of FIGS. 7*a* and 7*b* constituting first embodiments of security elements in accordance with the present invention;

FIG. 8 illustrates a second embodiment of a security element, viewed along its normal;

FIGS. 9*a*, 9*b* and 9*c* show, respectively, a second embodiment of an apparatus for magnetically imprinting indicia, the corresponding magnetic field shape and a corresponding security element formed using the apparatus;

FIG. 10*a* shows a third embodiment of a security element, FIG. 10*b* illustrating the orientation of the magnetic or magnetisable particles along a radial direction r of the security element;

FIGS. 11*a*, 11*b*, 11*c*, 11*d* and 11*e* show a fourth embodiment of a security element viewed from different angles;

FIG. 12 illustrates the security element of FIG. 8 viewed along its normal in the presence of two light sources;

FIGS. 13*a*, 13*b* and 13*c* schematically show a fifth embodiment of a security element, FIG. 13*a* illustrating a cross section through the element, FIG. 13*b* illustrating the security element viewed in reflected light; and FIG. 13*c* illustrating the security element viewed in transmitted light;

FIGS. 14*a* and 14*b* show a sixth embodiment of a security element viewed (a) in reflected light and (b) in transmission;

FIG. 15 shows two further embodiments of security elements viewed in reflection;

FIG. 16 is a block diagram of a second embodiment of a method of making a security element, suitable for making the security elements of FIGS. 13, 14 and 15;

FIGS. 17*a* and 17*b* show embodiments of documents of value carrying security elements; and FIGS. 18*a* and 18*b* illustrate two embodiments of transfer elements incorporating a security element, in cross section.

The ensuing description will focus on security elements used for example on documents of value, such as banknotes, passports, identification documents, certificates, licences, cheques and the like. However, it will be appreciated that the same security elements could be applied to any article for security purposes or to serve a decorative function, for example.

In all of the following embodiments and examples, the security element includes a layer containing magnetic or magnetisable particles. This may take the form, for example, of an ink which includes pigments containing magnetic or magnetisable materials. The particles are suspended in a composition such as an organic fluid which can be hardened or solidified by drying or curing, for example under heat or UV radiation. While the composition is fluid (albeit potentially highly viscous), the orientation of the magnetic or magnetisable particles can be manipulated. Once the composition is hardened, the particles become fixed such that their orientation at the time of hardening becomes permanent (assuming the hardening is not later reversed). Suitable magnetic inks which can be used to form this layer in all of the embodiments and examples to be described below are disclosed in WO-A-2005/002866, WO-A-2008/046702, WO-A-2002/090002. Suitable inks on the market include the Spark™ products by Sicpa Holding S.A. of Switzerland. Many such inks make use of magnetic optically variable pigments ("OVMI" pigments): that is, magnetic particles which have a different appearance depending on the angle of view. In most cases, this is achieved by the provision of a thin film interference structure incorporated into the element. Typically, the particles reflect light of one colour when viewed at one range of angles, and light of a different colour when viewed at a different range of angles. Such magnetic optically variable pigments are also disclosed in U.S. Pat. No. 4,838,648, EP-A-0,686,675, WO-A-2002/73250 and WO-A-2003/000801. Particularly preferred examples of magnetic optically variable pigments are given in WO-A-2008/046702 at page 8, lines 18 to 26, in which the magnetic material is incorporated within the thin film interference structure. However, embodiments of the present invention can also be implemented using compositions in which the magnetic or magnetisable particles are not optically variable, such as uncoated nickel or iron flakes. Nonetheless, optically variable magnetic particles are preferred since the optically variable effect adds complexity to the security element, both enhancing its appearance and leading to specific visual effects which increase the level of security achieved, as will be discussed below. The magnetic particle layer can be provided with additional materials to add extra functionality to the feature. For example, luminescent materials, and visible coloured materials could be added, including coloured tints.

The magnetic or magnetisable particles typically have the form of platelets or flakes. What is important is that the particles are non-spherical and have at least one substantially planar surface for reflecting incident light. In the presence of a magnetic field, the particles will become orientated along the magnetic field lines, thereby changing the direction in which each particle's surface reflects light and leading to the appearance of bright and dark regions in the layer. Particles having an elongate shape are preferred since the effect of the particle's orientation on the brightness of the layer will be more pronounced.

Figure 1:
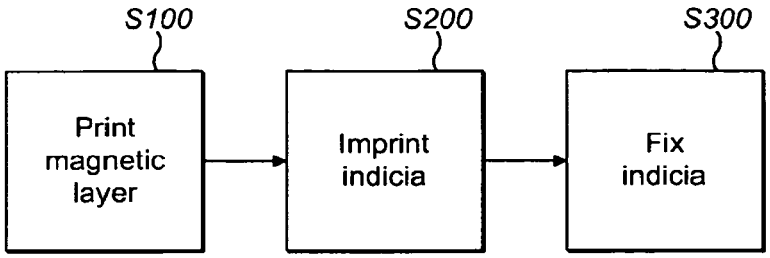
FIG. 1 is a block diagram depicting a first embodiment of a method of making a security element.

FIG. 1 shows steps involved in making a security element. In a first step S100, a layer containing magnetic or magnetisable particles is provided. Typically this may involve printing or coating a composition containing the particles—such as any of the magnetic inks mentioned above—onto a substrate. However, this process of forming the layer may be carried out separately beforehand if preferred and therefore need not form part of the presently disclosed technique, with ready-printed layers being supplied instead from which the security elements are to be formed. The layer is then magnetically imprinted with indicia in step S200, by placing the layer within a magnetic field configured to reorientate the magnetic or magnetisable particles as will be described in greater detail below. Finally, in step S300, the layer is hardened to fix the new orientations of the particles in order that the imprinted indicia will remain despite the removal of the magnetic field (or the presence of a different magnetic field). In preferred examples, the hardening is performed while the layer is situated within the orientating magnetic field so as to avoid any loss of orientation between the steps S200 and S300. However this may not be necessary if the layer composition is sufficiently viscous to restrict unintentional particle movement (under gravity, for example) and the layer is shielded from other magnetic fields.

Figure 2:
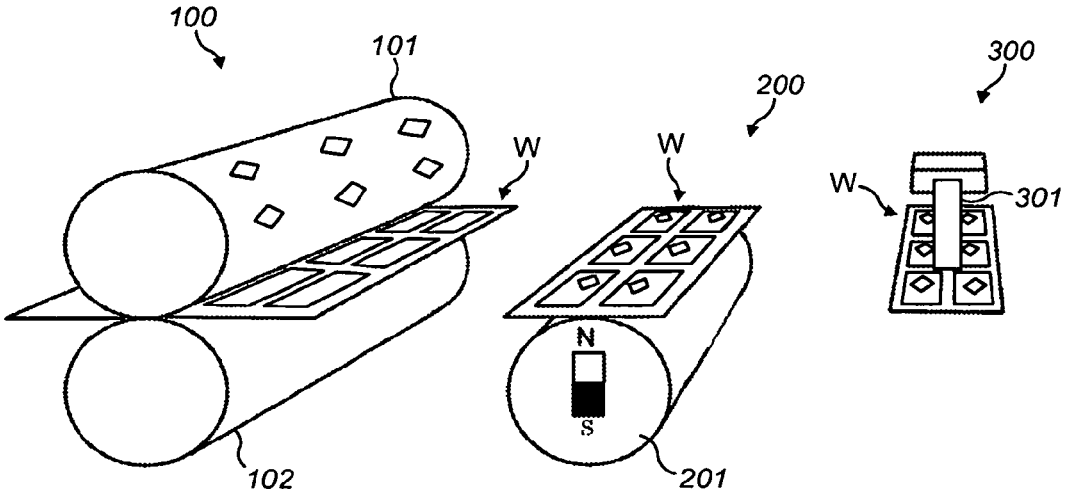
FIG. 2 shows schematically apparatus for carrying out the method of FIG. 1.

One particular example of apparatus suitable for implementing the process is shown in FIG. 2. Here, the layer containing magnetic or magnetisable particles is provided (step S100) using a printing apparatus 100 in the form of a rotary screen-printing press comprising a pair of rollers 101 and 102. The surface of the upper roller 102 is formed as a screen, such as a silkscreen, in which the design to be printed is defined. Ink is supplied to the interior of the screen and a stationary blade transfers the ink to a substrate through the screen according to the design as the substrate is conveyed through the nip between the rollers. The substrate can be a web W (as shown in FIG. 2), from which individual sheets or devices will later be cut, or the process can be sheet-fed. Screen printing is particularly preferred for formation of the magnetic layer since it permits a thick ink film to be applied to the substrate and can be used to print inks containing very large pigments. However, other printing and coating techniques can also be used, such as gravure or reverse gravure, both of which are capable of printing a low viscosity ink at a relatively heavy ink weight. Gravure is better suited to long print runs due to the cost associated with production of the printing cylinders. Magnetic ink layers of between 10 and 30 microns, preferably around 20 microns have been found particularly suitable for good display of indicia.

The imprinting assembly 200 used to magnetically transfer indicia to the printed layer comprises, in this example, a roller 201 containing an array of units each emanating a shaped magnetic field as will be detailed below. As the web W is conveyed across the roller, each printed area of magnetic ink is brought into proximity with a respective shaped magnetic field so as to reorientate the particles to display indicia. In alternative implementations, rather than use a roller, a plate carrying an array of apparatus emanating respective magnetic fields may be provided adjacent the web W which is either controlled to approach the web W at a position while the web is halted, or could be conveyed alongside the web W along the transport path for a distance to avoid interrupting sheet transport. The magnetic layer is then hardened at a curing station 300, which in this example comprises a UV irradiating element arranged to irradiate the web W as it is conveyed past.

The substrate selected for the device will be dictated by the end application. In many cases the substrate formed by the web W (or individual sheets) will be a security paper, formed of paper (cellulose), polymer or a composite of the two, and itself forms the basis of a document of value such as a banknote which is to carry the security element. A suitable polymer substrate for banknotes is Guardian™ supplied by Securency Pty Ltd. The security paper may be pre-printed with security prints and other data and/or may be printed after formation of the security element thereon.

However, in other implementations, the web W may be a film or other temporary support substrate whereby the security element can be formed as a sticker or transfer element for later application to an article, as will be described further with reference to FIGS. 16 and 17. For example, if the device is to be used as a thread, patch or stripe then the substrate is more likely to be PET though other polymer films can be used. If the device is to be used as a very wide tape suitable for embedding in paper, such as described in EP-A-1141480, then it is preferable that the substrate is BOPP.

If desired, the security element so-produced may be customized at an individual or series level immediately prior to application or post application to a secure document or other article. Customisation may be by a printing technique, e.g. wet or dry lithographic printing, intaglio printing, letterpress printing, flexographic printing, screen-printing, inkjet printing, laser toner and/or gravure printing, by a laser marking technique or by an embossing process such as intaglio blind embossing. The customisation may be aesthetic or define information such as a serial number or personalization data. For example, to introduce a coloured design to an otherwise monochromatic optical effect (the result of, for example, utilising uncoated nickel flakes as the magnetic particles), one or more regions of the element could be coloured by applying a semi-transparent coloured layer on top of the magnetic layer, and more than one differently coloured layer could be applied to provide a multi-coloured effect.

Figure 3:
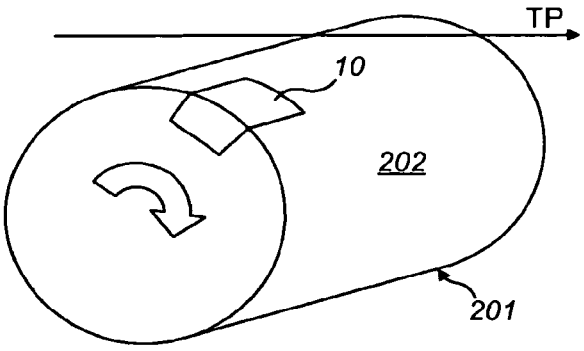
FIG. 3 shows an embodiment of an imprinting assembly forming part of the apparatus of FIG. 2.

FIG. 3 shows the roller 201 forming imprinting assembly 200 in more detail. Arrow TP represents the transport path along which the web is conveyed. The roller 201 supports in its surface 201 a number of units 10 incorporating apparatus for magnetically imprinting indicia, of which only one is depicted for clarity. The unit 10 is recessed into the roller surface 202 such that its surface sits substantially flush with the surface of the roller. The outward surface of the unit 10 is preferably curved in one direction so as to match the curvature of the roller.

A first embodiment of the apparatus used to magnetically imprint the indicia is shown in FIG. 4. FIGS. 4*a* and 4*b* show, respectively, a cross section through the unit 10, and a perspective view thereof, each depicting the components in an expanded arrangement for clarity. The outermost surface of the unit 10 is formed by a soft, magnetisable sheet 11. In use, the outer surface 11*a* of the sheet 11 will face the layer containing the magnetic or magnetisable particles which is to be imprinted. Directly adjacent the opposite, inner surface 11*b* of the sheet 11 is disposed a permanent magnet 12, which in this embodiment is substantially spherical although many other shapes can be used as will be discussed below. The shape of the permanent magnet is configured to produce the desired indicia. The upper surface (hemisphere 12*a*) of the magnet faces the interior surface 11*b* of the soft magnetisable sheet 11, and preferably contacts the sheet 11 at at least one point.

In this embodiment, the sheet 11 and permanent magnet 12 are held in fixed relation to one another through the provision of a housing 13, formed of a non-magnetic material such as plastic, preferably polyoxymethylene e.g. Delrin™ by DuPont. The housing 13 has a recess 13*b* formed in its upper surface 13*a* against which the interior of the sheet 11 sits once assembly is complete. The recess accommodates the permanent magnet 12 therewithin, preferably fully such that the curvature of the sheet 11 is not distorted by the magnet 12. Preferably the recess is posited to locate the magnet 12 approximately at the centre of the sheet 11. If necessary the permanent magnet 12 can be mechanically fixed to the housing 13. The recess 13*b* is preferably sized to fit the permanent magnet 12 closely so as to prevent any lateral movement thereof relative to the sheet 11. Both the upper surface 13*a* of the housing 13 and the sheet 11 are curved in one direction (about axis y in this example) to match the surface of the roller 201 as previously explained. The sheet 11 is joined to the housing 13 either by the use of an adhesive or adhesive layer (not shown) disposed between the sheet 11 and the upper surface 13*a* of the housing 13, or by a non-magnetic adhesive tape 14 disposed over the sheet 11 and adhered to the sides of the housing 13. As shown in FIG. 4*b*, the housing 13 may then be fitted into a block 15 for mounting the unit 10 into the roller. The fully assembled unit 10 is shown in FIG. 4*c*. It should be noted that, in other embodiments, the housing 13 and block 15 may be omitted, with the permanent magnet 12 and sheet 11 being directly fitted into the surface of the roller, for example.

As shown in FIG. 4*b*, the permanent magnet 12 is arranged such that the axis between its north and south magnetic poles is substantially parallel to the normal of the sheet 11 (which, since the magnet is located approximately at the centre of the sheet's curvature in this case, is parallel to the vertical axis z of the block). In this example the north pole is adjacent the sheet 11 although the same results would be achieved if the magnet's direction were reversed. In the case of a spherical magnet 12, this orientation is controlled by the sheet 11 itself, since when the sheet 11 is brought into the vicinity of the magnet 12, the sheet 11 will become magnetised and cause the magnet 12 to rotate until one or other of its poles faces the sheet 11 (as shown). In embodiments utilising other magnet shapes, the vertical N-S (or S-N) orientation may be set by appropriate positioning of the magnet and shaping of the recess designed to hold the magnet in place.

As noted above, the permanent magnet 12 is shaped so as to give rise to the indicia to be imprinted. That is, the magnetic field emanated by the permanent magnet includes perturbations (such as changes in direction) which lead to the display of indicia by the magnetic or magnetisable particles in the layer of the security element. Often, the form of the imprinted indicia will approximately follow the lateral shape of the permanent magnet (i.e. its maximum extent in the x-y plane) and so the permanent magnet may be of the same lateral shape as the desired indicia. However, it should be noted that the size of the indicia will generally not precisely match that of the permanent magnet since this depends on a number of factors including the strength of the magnet 12, the permeability of the sheet 11 and the proximity of the magnetic particle layer to the magnet 12 during imprinting. Thus, the permanent magnet may take a wide variety of shapes but at the least should produce a non-uniform magnetic field in order for indicia to arise. Examples of different permanent magnet shapes will be discussed below.

The soft magnetisable sheet acts as a focussing element for the magnetic field established by the permanent magnet, enhancing the field's perturbations and ultimately causing the indicia displayed by the magnetic or magnetisable particles to be more distinct and clearly defined than would otherwise be the case. Essentially, field lines intersecting the sheet are caused to permeate faster through the material (compared with the surrounding air), which leads to a concentration of the field perturbations in the immediate lateral vicinity of the permanent magnet.

FIGS. 5*a* and 5*b* illustrate this effect for the arrangement disclosed in FIG. 4, with FIG. 5*a* omitting the soft magnetisable sheet for ease of comparison. The approximate position taken by the magnetisable layer forming a security element during imprinting is indicated in dashed lines by item 20 in FIGS. 5*a* and 20' in FIG. 5*b*. In FIG. 5*a*, the magnetic field of the spherical magnet 12 is unmodified and the angle of the field lines through layer 20 vary slowly from vertical (i.e. parallel to the normal of the layer 20) in the centre to horizontal at the left- and right-most peripheries of the layer 20. In contrast, FIG. 5*b* (in which the sheet 11 is illustrated as spaced slightly from the magnet 12 only for clarity; in practice they are in contact) shows the focussing effect of the sheet 11 substantially increasing the curvature and density of the magnetic field lines and concentrating the perturbations into the immediate lateral vicinity of the permanent magnet. In the region of the layer 20', the angle of the field lines is, as before, substantially vertical over an area coinciding with the lateral midpoint of the spherical magnet 12. Moving toward the periphery of the layer 20', the field lines rapidly change from vertical to horizontal at points approximately coincident with the lateral extremes of the spherical magnet 12 (appearing as two "maxima" in the field, either side of the centre). The field lines then rapidly return towards vertical before becoming shallower once again until, at the periphery of the layer 20', they approach the horizontal (in line with the unmodified field). It will also be noted that, in the vicinity of the magnet 12, the field lines are much more closely spaced than those depicted in FIG. 5*a*, indicating the presence of a greater magnetic field strength.

Exemplary security element incorporating layers 20 and 20' are illustrated respectively in FIGS. 6*a* and 6*b* to show the resulting orientation of the magnetic or magnetisable particles contained therein. In each case, the particles 23/23' are depicted as lines representing the orientation of the particles' reflective surfaces. As previously mentioned, the particles are typically platelets or flakes in which case the depicted lines represent cross-sections therethrough. In FIG. 6*a*, layer 20 is shown disposed on a substrate 21, under which the magnet 12 was arranged during imprinting (the magnet arrangement could be disposed on the upper side of the layer 20 with similar results). The layer 20 comprises magnetic flakes 23 suspended in a fluid 24. In a central region A of the layer, substantially coinciding with the centre of the magnet 12, the particles have a substantially vertical orientation, causing the region A to appear dark when viewed along the normal to the layer, since very little light will be reflected by the particles. Surrounding the central region A is an annular peripheral region B across which the angle of the particles changes slowly from vertical towards horizontal. This region will appear increasing bright. At the periphery of the layer, the flakes remain substantially horizontal and, hence, bright. Viewed from the normal to the layer, the indicium appears as an indistinct, dark "hole" in the otherwise bright layer. The edges of the "hole" appear blurred due to the slow increase in brightness.

In contrast, layer 20', shown in FIG. 6*b* and forming a first embodiment of a security element in accordance with the present invention, displays a sharply defined indicium. As in the previous case, a central region A coinciding with the centre of the magnet 12 appears dark since here the particles are substantially vertical. Moving radially outward, the angle of the particles rapidly changes across a narrow region B from vertical to horizontal (the position of which coincides with the "maxima" seen in FIG. 5*b*). The particles then reorientate rapidly towards the vertical across another narrow annular region C until a point at which the angle between the plane of the particle and the normal of the layer 20' begins to increase once more, across a region D. In appearance, the regions B and C define between them a bright edge forming a circular outline or "ring" E which, viewed from along the normal to the layer 20' contrasts distinctly with the dark interior region A/B and with the dark periphery C/D. Since the angle of the particles in the region C/D may not quite reach vertical, this region may appear slightly less dark than the centre region A, but it will still present a sharp contrast to the bright ring E. The thickness t of outline E is determined by the rate of change of particle orientation across regions B and C. The bright ring E is readily recognisable and makes a significant visual impact.

FIG. 7*a* shows a first embodiment of a security element 30 which has been formed using the arrangement of FIG. 5*b*, viewed in daylight along the element's normal. In this case, the security 30 has been formed on a substrate 31 by printing the layer 30 thereon. The substrate 31 is a banknote and it will be noted that background security prints are visible adjacent the security element. As a whole, the layer 30 is substantially circular in shape, although two chevron or "V"-shaped gaps 35 are formed in the layer, directed inward from the periphery. The function of these will be described below. The security element 30 displays a bright ring 32 which is clearly defined between a central dark region 34, corresponding to regions A/B of FIG. 6*b* and a peripheral dark region 33 corresponding to regions C/D. The thickness t of the ring 32 is approximately 2 to 3 mm, and its diameter d corresponds closely to the actual diameter of the permanent magnet 12 (in this case, 8 to 9 mm). The bright ring 32 has a considerable visual impact, contrasting sharply with the dark remainder of the element. Additionally, in this embodiment it will be seen that the ring 32 has a 3-dimensional quality, appearing to have depth in the dimension parallel to the element's normal. This is a result of the gradual change in magnetic particle angle achieved using the arrangement described above.

This 3-dimensional effect also manifests itself in apparently lateral movement of the bright ring when the element is tilted. FIG. 7*b* shows another version of the security element 36, produced in the same manner as that of FIG. 7*a*, but here the view is taken at an angle to the element's normal. It can be seen that the bright, 3D ring 37 is still clearly visible, but it appears to have moved towards the lower periphery of the element. In addition, on one side of the ring (its lower half), the background peripheral region of the element appears brighter than before and this in itself presents a useful security feature, as will be discussed further below.

For comparison, FIG. 7*c* shows a security element 38 identical to that of FIG. 7*b* and viewed at the same angle, except produced using the magnetic field of FIG. 5*a*, in the absence of the soft magnetisable sheet 11. It will be seen that the bright indicia 39 displayed is very indistinct, in particular towards the lower periphery of the element. When viewed at the normal, the indicia appears in the form of a dark "hole" surrounded by a bright region extending from the edge of the hole to the periphery of the element. The thickness t of the bright region 32 is over 5 mm and no outer edge of the bright region is visible.

Overall therefore, the strong, distinct, bright indicia displayed by elements 30 and 36 constitute a significantly improved optical effect compared with that of element 30.

To achieve the best results, the permanent magnet 12 should be of a high magnetic strength: the present inventors have found that a permanent magnetic material having a magnetic remanence (=residual flux density) of at least 3000 Gauss (1 Tesla=$10^4$ Gauss) is desirable in order that a bright, distinct indicia is produced. Increasing the magnetic strength of the permanent magnet further improves the visual result, and further increases the three-dimensional aspect of the image. The inventors have found that a minimum magnetic remanence of around 3500 Gauss is desirable in order to achieve a reasonable 3D effect. However, materials having a remanence of around 8000 Gauss or more are found to be the most effective. Preferably the permanent magnet has a remanence of at least 10000 Gauss, most preferably at least 12000 Gauss. Examples of suitable materials for the permanent magnet 12 and their approximate magnetic characteristics are given in Table 1 below alongside an example of a permanent magnet material which will produce a less distinct effect (plastoferrite). It will be appreciated that any other permanent magnetic materials of suitable magnetic characteristic could alternatively be used.

TABLE 1

| Material | Grade/ Orientation | Remanence (G) | Max. Energy Product (G · Oe) | 3D effect Observed? |
|---|---|---|---|---|
| Neodymium | N33 | 11700 | $33 \times 10^6$ | Yes |
| | N48 | 14200 | $49 \times 10^6$ | Yes |
| | N35 | 12000 | $34 \times 10^6$ | Yes |
| AlNiCo Min | | 11000 | $4.3 \times 10^6$ | Yes |
| (anisotropic) | Max | 13000 | $5.6 \times 10^6$ | Yes |
| SmCo | Min | 8600 | $17 \times 10^6$ | Yes |
| (anisotropic) | Max | 11500 | $31 \times 10^6$ | Yes |
| Hard ferrite | Min | 3600 | $2.8 \times 10^6$ | Marginal |
| (anisotropic) | Max | 4000 | $3.5 \times 10^6$ | Marginal |
| Plastoferrite | Min | 1500 | (unknown) | No |
| | Max | 2200 | (unknown) | No |

In contrast, the soft, magnetisable sheet is a non-permanent magnet and is preferably formed of a material having low coercivity and, correspondingly, low magnetic remanence. For example, the coercivity of the material should preferably be no more than 25 Oe (oersted), preferably less than or equal to 12 Oe, more preferably less than or equal to 1 Oe, still preferably less than or equal to 0.1 Oe and most preferably around 0.01 to 0.02 Oe. For instance, the "PC permalloy (78% nickel)" supplied by NAKANO PERMALLOY Co., LTD. of Japan is suitable and has a coercivity of 0.015 Oe (=1.2 A/m). For certain nickel alloys, an even lower coercivity of around 0.002 Oe can be obtained. Very low remanence and coercivity means the material responds substantially linearly to an applied magnetic field in order to enhance the perturbations of the magnetic field from the permanent magnet without imposing any distortions as a result of persistent magnetisation in the sheet itself. In order to achieve a strong focussing effect, the sheet material preferably has a high magnetic permeability (absolute or relative). The greater the permeability, the "faster" the magnetic field lines are caused to cross the sheet and hence the greater the curvature and flux density increase achieved in the local magnetic field. The present inventors have found that a relative permeability of at least 100 is preferred. To achieve still improved visual results, the relatively permeability is preferably greater than or equal to 500, more preferably greater than or equal to 1000, still preferably greater than or equal to 4000, most preferably greater than or equal to 8000. Examples of suitable materials from which the sheet may be formed, and their approximate magnetic properties, are given in Table 2 below. It will be noted that some materials cited in fact cover large compositional ranges and hence the approximate magnetic characteristics are given as corresponding ranges.

TABLE 2

| Material | Permeability, μ (H/m) | Relative permeability, $\mu/\mu_0$ (at a magnetic flux density of 0.002 Tesla) | Coercivity (Oe) |
|---|---|---|---|
| Ferrite (nickel-zinc) | $20$ to $800 \times 10^{-6}$ | 16 to 640 | 2 to 24 |
| Nickel | $125 \times 10^{-6}$ | 100 to 600 | 5 |
| Steel | $875 \times 10^{-6}$ | 100 | 2 |
| Electrical Steel | $5000 \times 10^{-6}$ | 4000 | 0.07 to 0.6 |
| Iron (99.8% pure) | $6.28 \times 10^{-3}$ | 5000 | 0.15 |
| Permalloy (Ni—Fe) | $10000 \times 10^{-6}$ | 8000 | 0.006 to 0.3 |
| Mu-metal | $25000 \times 10^{-6}$ | 20000 | 0.01 |
| Supermalloy | 1.26 | 1000000 | 0.005 |

The thickness of the soft, magnetisable sheet will also have an effect both on the amount of field focussing achieved and on the 3-dimensional effect of the indicia. One of the key advantages of the presently disclosed technique is that the permanent magnet is close to the upper surface of its housing and therefore close to the layer to be imprinted during processing, preferably spaced only by the sheet 11. This enables the magnetic field strength experienced by the magnetic particles to be correspondingly high, significantly enhancing the degree of orientation of the particles. The greater the thickness of the sheet (parallel to its normal), the greater the spacing between the permanent magnet and the layer carrying the magnetic particles, during imprinting, and hence the lower the apparent field strength experienced by the particles. In addition, if the sheet is very thick, it can have a shielding effect on the magnetic field. Hence, too thick a sheet can reduce the optical effect of the indicia. The present inventors have found that the best results are achieved using a thin sheet of less than 2 mm, more preferably less than or equal to 1 mm, still preferably less than or equal to 0.5 mm, most preferably less than or equal to 0.25 mm. In any case, the sheet should be no thicker than 5 mm. In practice, the minimum thickness of the sheet is determined by the practical requirement that the sheet should be sufficiently strong to physically retain the magnet within the recess of the housing. A sheet thickness of 0.01 mm has been found to be sufficient for this purpose, though a minimum thickness of around 0.05 mm is preferred. The sheet thickness should preferably be substantially constant over its area, at least in the vicinity of the permanent magnet. However, thickness variations (even cut-outs) in regions of the sheet spaced sufficiently far from the permanent magnet may not have a significant effect on the resulting optical feature. In certain embodiments, the sheet could optionally be modified to include thickness variations, if it is desired to introduce further modifications to the magnetic field and resulting optical effect (over and above the indicia resulting from the configuration of the permanent magnet).

Of course, in designing an apparatus for magnetically imprinting indicia according to the above principles, the characteristics of the permanent magnet and soft magnetisable sheet should be considered in combination since the result achieved will be influenced by both. For instance, the optical effect achieved using a lower strength permanent magnet will be improved by the provision of a very high permeability and thin magnetisable sheet. Similarly, if the permanent magnet is of high strength, a thicker or lower permeability sheet may be utilised. Of course, the best results will ultimately be achieved by using a very high strength permanent magnet in combination with a very thin, high permeability sheet.

For example, the security element depicted in FIG. 7*b* was formed using the apparatus illustrated in FIG. 4 wherein the permanent magnet 12 was a sphere of approximate diameter 8 to 9 mm, made of grade N35 neodymium. The sheet 11 was formed of permalloy having a composition 77% Ni, 23% Fe and approximately 0.25 mm thick, 28 mm×28 mm square. The magnetic ink used was "Green to Gold" Spark™ ink available from Sicpa Holdings S.A., printed at a thickness of around 20 microns on average (the particular composition of which is proprietary but similar, it is believed, to the examples given in their patent application WO-A-2005/002866, which could also be used). During imprinting, the substrate 31 carrying the layer 30' was placed directly against the outer surface of the sheet 11, spaced only by adhesive tape 14. The total distance between the uppermost point of magnet 12 and the layer 30' during imprinting was therefore approximately 0.4 mm (including a typical substrate thickness of around 120 microns and an adhesive tape thickness of around 40 to 60 microns, plus the thickness of the sheet 11). Using this set-up, the maximum sheet thickness found to produce reasonable results was found to be around 1.5 mm. Improved results were achieved with a sheet thickness over 1.25 mm or less. Such effects were still observed at a sheet thickness of 0.05 mm. In more general cases, a spacing of up to 5 mm (though preferably no more than 3 mm) between the top of the permanent magnet and the layer being imprinted has been found to produce good results.

The 2D layout of the layer to be imprinted will also have an effect on the visual impact of the security element and should be designed in conjunction with the configuration of the imprinting apparatus, particularly the indicia produced. FIG. 8 shows a schematic of a second embodiment of a security element 40, viewed along its normal. The element comprises the layer 40, containing the magnetic or magnetisable particles, printed or coated onto a substrate such as a banknote in an 8-sided star shape. As before, the indicia 42 takes the form of a bright circular outline or ring, produced using the same apparatus and technique as previously described with reference to FIGS. 4, 5*b*, 6*b*, 7*a* and 7*b*. The thickness t of the bright ring is, again, about 2 to 3 mm. The internal diameter $d_1$ of the ring is approximately 8 to 9 mm, corresponding closely to that of the spherical permanent magnet 12 (having diameter 8 to 9 mm). In order that the sharp, defined ring can be viewed, the lateral extent of the layer 40 should be such that there is a visible space s between the bright ring 42 and the periphery of the layer at least at some positions around the ring 42 (it will be noted that in the example of FIG. 7, the "V"-shaped gaps mean that this condition is not fulfilled around the whole circumference of the ring). Preferably there is a space s outside the ring at least at opposite sides of the ring 42. However, it has been found that, in order to accentuate the 3D effect of the indicia, the lateral extent of the layer should not be substantially greater than that of the indicia, in order that the 3D indicia appears reasonably close to the periphery of the layer. This provides a contrasting reference feature against which to judge the apparent position of the ring at different viewing angles. Since the size of the indicia 42 is determined by the size of the permanent magnet, this corresponds to the requirement that the lateral extent of the layer should not be substantially greater than that of the permanent magnet. For instance, in FIG. 8, the diameter $d_2$ of the star-shaped layer 40 varies between approximately twice that of the ring ($d_1$), and 2.5 times that of the ring. In more general cases, it has been found preferable that the layer should have a lateral dimension between 1.25 and 5 times greater than that of the permanent magnet, preferably between 1.25 and 3 times greater than that of the permanent magnet, still preferably between 1.25 and 2 times greater than that of the permanent magnet.

This can alternatively or additionally be thought of in terms of the spacing s between the indicia 42 and the periphery of the layer 40. This can also be adjusted by controlling the lateral position of the layer relative to the position of the permanent magnet during imprinting, since the bright indicia will typically be approximately aligned with the lateral extremity of the magnet. Therefore, in preferred examples, during imprinting the layer is placed adjacent the outer surface of the soft magnetisable sheet in a position whereby a periphery of the layer is laterally displaced from the nearest lateral periphery of the permanent magnet by between 0.5 and 2 cm, preferably between 0.5 and 1.5 cm, more preferably between 0.5 and 1 cm, leading to corresponding values of the spacing s in the finished security element.

In addition to controlling the size of the layer relative to the indicia, it has been found advantageous to provide the security element with one or more registration features (or "datum" features) against which the position of the indicia may be judged. In preferred examples, such features may take the form of gaps in the printed layer of magnetic ink. The colour of the magnetic ink preferably contrasts with the underlying substrate (or with the article on which the element is to be placed) such that the gaps clearly stand out. The gaps may amount to apertures, being surrounded by portions of the layer on all sides, or could comprise formations in the peripheral edge of the layer. For example, the "V"-shaped gaps 35 described earlier with reference to FIG. 7 perform this function. In the embodiment of FIG. 8, the points of the star act as reference positions. Further examples will be described below with reference to FIG. 11. In addition, or as an alternative, registration features could be provided by printing a marker on top of the magnetic layer. Any known printing technique could be used for this including lithography, gravure, flexo, intaglio, letterpress, screen or digital printing techniques such as laser or inkjet printing. An additional effect that can be achieved is that the presence of the optically variable effect in the magnetic ink can be used to highlight the registration feature, drawing the viewer's attention to it. For example, the registration feature could take the form of a series of letters or numbers printed onto the magnetic ink or formed as gaps therein. The magnetic indicia can be arranged to appear behind or around a selected one (or more) of the letters or numbers, thus highlighting those selected features relative to the others. The indicia can also be arranged such that, upon tilting of the element, the indicia appears to move past the datum features, for example in the direction that a word or serial code formed by the features would be read in.

In all of the embodiments of imprinting apparatus, techniques and security elements described so far, the permanent magnet 12 is spherical and so the resulting indicia takes the form of a 3-dimensional circular ring. However, as alluded to above, the indicia can be adapted to any desired shape, 3D or 2D, by suitable selection of an appropriately shaped permanent magnet 12. In addition, more than one such magnet may be provided (either in corresponding recesses within the housing 13 or in a single recess sized to accommodate multiple magnets), configured either to produce multiple, separate indicia in the magnetic layer, or to work in combination with each other to produce a single indicium. For example, to form a letter, number or other symbol from a series of adjoining rings, multiple spherical magnets could be arranged in the shape of the desired letter, number or symbol.

Generally, in order to achieve a strong 3-dimensional appearance and movement effect (which is not essential, but is preferred since it leads to an enhanced visual appearance and thus an improved authentication ability), it has been found that the permanent magnet should either be shaped such that its upper surface does not sit flat against (or conform with) the soft magnetisable sheet, or if a flat-profile magnet is used, it should be spaced from the sheet. Essentially, the magnetic field produced by the magnet should vary in direction across the magnet in the region where it intersects the magnetisable sheet. For example, the upper surface of the magnet could be curved or sloped relative to the sheet. Suitable magnet shapes include domes such as hemispheres and pyramids, etc. However, any shape of magnet which establishes a magnetic field of varying direction can be used. Preferably, the direction of the magnetic field varies between the centre of the magnet and its lateral periphery.

An example of an apparatus 50 which utilises a cuboid shaped magnet 52 is shown in FIG. 9*a*. In this example, the soft magnetisable sheet 51 is flat rather than curved (suitable for use in an imprinting plate comprising an array of such apparatus, for example, rather than a roller), and the upper surface 52*a* of the magnet 52 therefore conforms to the interior surface 51*b* of the sheet 51. If, in use, the magnet 52 makes contact with the sheet 51 across its upper surface 52*a*, the resulting imprinted indicia will take the form of a sharp, well defined outline around the cuboid, but it will not have a 3-dimensional appearance nor appear to move when the element is tilted. This is because, at the edges of the magnet, the change in magnetic field direction occurs so rapidly that there is an abrupt discontinuity between vertical flakes immediately above the magnet's surface, and horizontal flakes immediately above the magnet's periphery, without any gradual change of flake angle therebetween.

Whilst this optical effect is useful, and may be the desired result in many embodiments, in other embodiments it is preferred to make use of the 3-dimensional effects previously described. To do so using a flat-profile magnet such as cuboid 52, the magnet should be spaced a short distance from the sheet 51 as shown in FIG. 9*a*. The spacing between the magnet 52 and sheet 51 is preferably between 1 and 5 mm, and can be achieved either providing a layer of spacing material between the magnet and the sheet, or through design of the housing in which the magnet is mounted. Any material disposed between the magnet 52 and sheet 51 should, however, be non-magnetic so as not to disrupt the magnetic field—in general, plastics materials will be most suitable. FIG. 9*b* shows the resulting magnetic field, focussed by the sheet 51 in the same way as previously described, and FIG. 9*c* shows a plan view of a security element 55 imprinted using the apparatus of FIG. 9*a*, on a substrate 56. It will be seen that the resulting indicia 57 is a bright outline taking the approximate form of a rectangle corresponding to the periphery of magnet 52. The bright outline contrasts with the interior dark region 58 and the peripheral dark region 59. The outline has a 3-dimensional appearance (not depicted in the Figure), and appears to move towards the periphery of the element 55 if viewed at an angle.

The above described techniques lead to the creation of new types of security elements displaying novel optical effects, which have not previously been achievable. In particular, the display of a distinct, bright edge defined sharply between dark interior and peripheral regions (when viewed along the normal) has been found to have a strong visual impact. It has been found particularly effective where the bright edge takes the form of a loop or outline, though this not essential. The present inventors have found that the bright edge is particularly pronounced where the orientation of the magnetic particles varies within the lateral extent of the layer from substantially vertical (parallel to the normal of the layer) to horizontal and back towards vertical with the normals to the particles' reflective surfaces intersecting one another at points on one side of the layer (e.g. that away from the viewer) before increasing again with the normals to the particles' reflective surfaces in this region intersecting one another on the other side of the layer (e.g. that facing the viewer). This is the case in the embodiments depicted in FIGS. 7*a*, 7*b*, 8 and 9 above, and a further example is depicted in FIG. 10.

FIG. 10*a* shows a third embodiment of a security element 60 comprising a layer of magnetic ink having an irregular "starburst" shape on a substrate 61. The layer displays a bright triangular outline 62 having a contrasting dark interior region and being surrounded by a dark peripheral region. An arbitrary radial direction extending from the dark, interior region of the outline to the periphery of the layer is shown by the arrow r, which makes an angle $\alpha$ with a nominal reference axis y. The normal to the plane is parallel to the axis z.

FIG. 10*b* schematically shows the arrangement of the magnetic or magnetisable particles 63 within the layer 60 along the radial direction r. In a first part 64 of the layer, inside the triangular outline, the particles align substantially parallel to the normal (axis z). This region preferably substantially coincides with the centre of the layer 63 but this need not be the case. Moving along the radial direction r, the angle between the normal and the particle gradually increases from zero to a maximum across a region 65 (here, the term "gradually" should not be taken to imply that the rate of change of angle with distance is slow, but rather that the change in angle occurs smoothly over a finite distance, rather than switching suddenly and discontinuously at a point). The angle is at a maximum of approximately 90 degrees, with the particles lying substantially parallel to the plane of the layer, at a first radial position 66 which corresponds to the mid-point of the bright triangular outline 62. The angle between the normal and the particles then gradually decreases across a region 67 until a second radial position 68. At this point the angle between the normal and the particles is preferably low—ideally zero, but more generally less than 45°, preferably less than 30°, more preferably less than 10°—such that the area appears dark. From the second radial position 68, the angle of the flakes gradually increases once more across a region 69, which may extend all the way to the periphery of the layer (if further magnetic indicia are not present). Between the first dark area 64 and the second radial position 68, the normals to the particles' reflective surfaces (a selection of which are indicated in dashed lines labelled (i)) intersect one another at points on the substrate side of the particles (i.e. beneath the particles, away from the viewer), whereas those outside the second radial position 68 (labelled (ii)) intersect one another at points on the side towards the viewer. Thus the angled particles appear to follow the maxima of a curve, when viewed in cross section through the layer, which then shallows out towards the periphery after a change in curvature at the second radial position 68. In other examples the flake arrangement could be reversed such that the normals in the region 65 to 67 intersect on the upper side of the layer, and those in region 69 on the underside of the layer.

This arrangement of particles has been found to produce particularly clear and distinct results, displaying a bright and well defined outline. The visual impact is more striking than that achieved by conventional security elements, thereby causing the element to be more noticeable to a user and more readily distinguished from a counterfeit (such as a region printed in the same colour as the security element intended to give the same overall impression as the security element). The level of security achieved by the element is therefore increased, compared with known elements.

To sharply define the bright outline, the distance over which the angle of the flakes increases to horizontal across region 65 and decreases again across region 67 is preferably high: in preferred examples, the total distance from the start of region 85 to the second radial position is between 2 and 5 mm. This results in a narrow, bright ring, the thickness of which may depend on lighting conditions but under daylight (in which it will appear broadest), the thickness is less than around 10 mm, preferably less than 5 mm and more preferably still less, e.g. between 1 and 4 mm or 2 to 3 mm. More specular lighting conditions (including bright sunlight and indoor lighting) will tend to give a narrower outline appearance.

The rate of change of particle angle should be less in the region 69 outside the second radial position 68 than immediately adjacent the outline at 66, in order that the dark region outside the outline is sufficiently wide that the outline clearly stand out against it (when viewed at the normal). The rate of change in the region 69 should preferably be substantially less than that in regions 65 and 67 and in particularly preferred cases, the particles in region 69 will not reach the horizontal position before the periphery of the layer 60. If the layer 60 is sufficiently wide that the particles do reach the horizontal position, it is preferred that there is adequate spacing of at least 2 mm, preferably at least 3 mm, more preferably at least 5 mm or even 10 mm, between the second radial position 68 and the point at which the particles become horizontal.

In this way, the region 69, which forms the "background" of the element, will appear dark when the element is viewed along its normal because the vast majority of the particles therein will be non-planar with the element, even if only by a relatively small angle (to the plane of the element). However, since the particles are near-horizontal, this leads to the advantageous effect that portions of the background will appear bright if the element is tilted. Since the angle and direction of tilt will vary across the element, the bright portion of the background will appear to move across the element as it is tilted, in a similar manner to the known "rolling bar" effect. Thus the bright outline appears superimposed on a dynamic, rolling bar background.

Whilst the security element can be implemented and achieve all the above effects using mono-chromatic magnetic inks (such as nickel flakes), further impressive optical effects can be achieved through the use of OVMI pigments, as previously mentioned. In particular, this leads to the background region 69 appearing to have portions of two different colours when viewed at an angle, the boundary between the two colours moving across the element as the element is tilted. The combination of this effect with the bright outline provides a significant visual impact.

To produce the security element, any technique capable of orientating the particles in the above-described way may be used, the methods and apparatus described above with reference to FIGS. 1 to 9 (utilising either a flat, triangular-shaped permanent magnet spaced from the sheet, or a pyramid shaped magnet contacting the sheet, for instance) being a particularly preferred example. The particular method and apparatus used to create the FIGS. 7*a* and 7*b* embodiment could also be used, to produce a circular outline.

If a non-complete "outline" or edge is desired (such as an arc or straight line), this can be produced by positioning the magnet relative to the layer such that only the portion containing the desired edge feature overlaps with the layer. For example, the periphery of the layer could be approximately aligned with the centre of a spherical magnet to obtain a semi circular bright edge. The edge can also be arranged to include gaps, e.g. by shielding only selected portions of the magnetic field.

As in the case of the FIG. 10 embodiment, the variation of particle orientation with radial distance need not be the same for every radial direction. For instance, in the FIG. 10 example, the first radial position 66 will be located farther from the centre of the dark area 64 at angular positions $\alpha=0°$, $\alpha=120°$ and $\alpha=240°$ (the three corners of the triangle) than at angles between those positions. The shape of the outline can therefore be selected as desired by appropriate location of the first radial position along each radial direction. For example, a circular outline will be formed if the first radial position is spaced from the centre by the same amount in each radial direction. In other examples, the outline shape could be square, rectangular, otherwise polygonal, or could define a letter, number or symbol for instance.

The first dark area is preferably located wholly within the bounds of the magnetic layer, so that the full bright outline is visible. However, in other implementations, the first dark area could be located on or adjacent to the periphery of the layer so that only a portion of the full outline is visible.

In order to achieve maximum visual impact, the same considerations apply to the 2D layout of the layer 60 as previously discussed with respect to FIGS. 7 and 8. In particular, the lateral extent of the layer 60 is preferably sized so as to make visible the dark region 69 around most, if not all, of the outline 62, but such that this spacing is not excessive, the outline still appearing in relatively close proximity to the periphery of the layer. Similarly, the sharply angled edges of the "starburst" shape provide registration features against which the position of the outline 62 can be judged.

FIG. 11 shows a fourth embodiment of a security element 70 to demonstrate further the 3-dimensional effect that can be achieved via particular implementations of the method of FIGS. 4 to 9, and in embodiment of security elements such as that in FIG. 10. FIG. 11*a* shows the security element 70 viewed along its normal (perpendicular to the x-y plane), FIG. 11*b* shows the security element tilted backwards (away from the viewer), FIG. 11*c* shows the security element tilted to the right, FIG. 11*d* shows the security element tilted forwards (towards the viewer), and FIG. 11*e* shows the element tiled to the left.

Figure 11A:
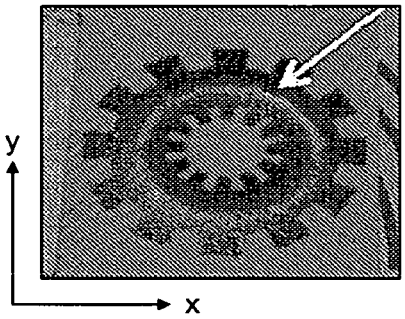
Figure 11B:
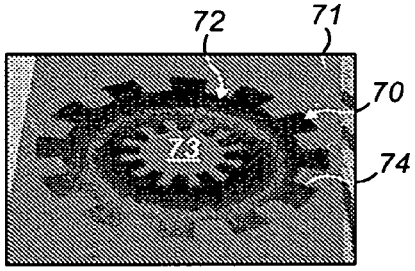
Figure 11C:
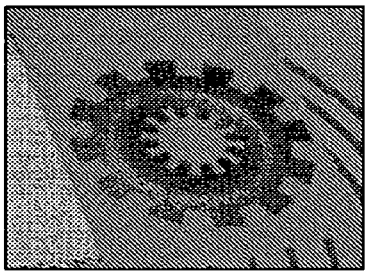
Figure 11D:
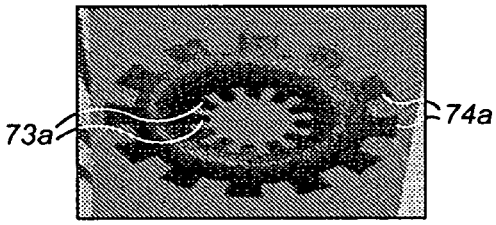
Figure 11E:
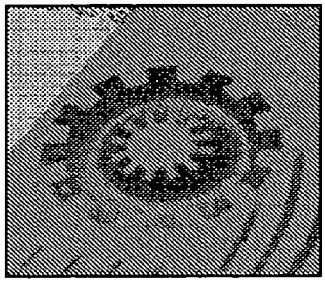

In this case, the layer 70 is approximately annular. At the centre of the layer, there is a substantially circular gap 73 through which the underlying substrate 71 is revealed. The indicia 72 displayed by the layer 70 is a bright circular ring which is located between the outer edge of the circular gap 73, and the ultimate periphery 74 of the layer (i.e. within the annular, printed region). As in the case of the security element 60 shown in FIG. 10, this is a result of the angle of the magnetic flakes in the layer 70 changing from vertical in a first dark area (which in this case annularly surrounds the gap 73) to horizontal and back towards vertical over a short lateral distance, with their normals intersecting on another on the side of the layer 70 facing towards the substrate. Comparing FIGS. 11*a* to 11*e*, it can be seen that the apparent position of the bright ring 72 relative to the periphery of the layer 70 (and to the central gap 73) changes depending on the angle of view. When the security element is viewed along its normal (FIG. 11*a*), the bright ring is approximately equidistant from the gap 73 and periphery 74. When the element is tilted away from the viewer (FIG. 11*b*), the ring 72 appears to move closer to the portion of the layer's periphery nearest the viewer, and no longer appears centred. Similarly, the ring appears to move away from the viewer when the element is tilted in the opposite direction (FIG. 11*d*). Likewise, when the element is tiled to the left and to the right (FIGS. 11*e* and 11*c* respectively), the ring 72 appears to approach the edge of the element towards the direction of view. This apparent movement is very distinct and therefore improves the security level of the element.

In addition to central gap 73, the security element 70 includes a "square wave" pattern of gaps 73*a*, 74*a* along the outer edge of centre gap 73 and along periphery 74 respectively. Like central gap 73, these act as registration or "datum" features which emphasise the apparent movement of the ring 72 to an observer by decreasing the spacing between the ring 72 and the contrasting background of substrate 71 at least in places. The substrate 71 is preferably of a colour which contrasts both with the dark regions of the magnetic ink and with the bright regions. For instance, in this example, the substrate is printed with an orange security pattern. The dark regions of the magnetic ink layer 70 appear black, and the bright ring 72 appears green. The colour of the bright ring will depend on the nature of the magnetic or magnetisable particles (e.g. whether they are provided with an optically variable structure) and on any tint carried by the composition in which they are suspended.

FIG. 12 illustrates another optical effect achievable in security elements as described in relation to FIG. 10, or formed using the techniques of FIGS. 3 to 9. For simplicity, the security element 40 depicted corresponds to that of FIG. 8, and was produced in the same way. The Figures so far, however, have depicted the appearance of the security elements under ambient lighting conditions, which generally involves a single, albeit potentially diffuse, light source. When the element is viewed under multiple light sources, however, corresponding multiple bright edges become visible in the magnetic layer: for instance, where there are two (spaced) light sources, two edges will be visible, matching in shape but displaced from one another by an amount and direction dependent on the arrangement of the light sources.

FIG. 12 shows, as an example, the security element 40 viewed under two light sources. Rather than displaying a single bright ring, as shown in FIG. 8, the element now shows two circular outlines 42*a*, 42*b* of the same shape and size as each other but laterally displaced such that they appear to overlap. The regions 43, 44, 45*a* and 45*b*, defined between and outside the rings 42*a*, 42*b* are each dark and contrast distinctly with the bright rings. The thickness t of each ring is approximately the same, in this example around 2 to 3 mm. Provided both light sources are reasonably diffuse, the two rings will each have a 3-dimensional appearance. The maximum spacing between the two rings (within the regions 45*a* and 45*b*) depends on the lighting conditions but is generally around 1 to 5 mm. As the element is tilted, the outlines move relative to one another as a result of the changing angles made with each light source. The multiple ring effect can be obtained using any type of magnetic ink, but is particularly striking when the element is formed using OVMI pigments. In this case, the two outlines appear as different colours at certain angles of view. The ability to view a different number of bright edges (preferably outlines) significantly enhances the security element's ability to act as an authenticator since a user can easily test the feature by inspecting the appearance of the element, and counting the number of edges, under different lighting conditions.

FIG. 13 illustrates a fifth embodiment of a security element incorporating magnetically imprinted indicia. FIG. 13*a* shows a cross section through the security element 90 and a substrate 91 on which the security element is disposed, FIG. 13*b* shows a plan view of the security element, as observed in reflected light, and FIG. 13*c* shows a plan view of the security element as seen in transmitted light (i.e. the light source being located on the opposite side of the substrate 91 from the security element 90). The substrate is translucent (i.e. not opaque), at least in the region of the magnetic indicia. For example, the substrate may be a banknote formed of paper or coated polymer which is translucent through not necessarily transparent. In other cases, the security element could be arranged at least partly over a window in the substrate, such as a transparent polymer window or an aperture. In general, the substrate could be formed for example of paper, security paper, polymer, coated polymer or any combination thereof (e.g. as a multilayer structure).

The security element 90 comprises a print layer 92 and a magnetic layer 93 of a composition containing magnetic or magnetisable particles such as that previously described. In use, the print layer 92 is located between the magnetic layer 93 and the substrate 91. This will typically be achieved by printing the print layer 92 onto the substrate in a first process step and then over-printing the layer 92 with magnetic ink to form layer 93. However, other manufacturing techniques are also envisaged: for instance, the magnetic layer 93 may be formed on a temporary support substrate in a first step, and the print layer 92 applied thereto before the two layers are transferred to the substrate 91.

The print layer 92 comprises markings represented by items 92*a*. These could be purely decorative or include symbols, letters or digits, as desired. At least some of the markings formed by print layer 92 constitute authentication data 94. This too could take any desirable form, such as letters, numbers, symbols, graphics or simply a pattern. The term "authentication data" simply means that the data can be used as follows to confirm that the security element is genuine. The print layer may also include other markings forming visible data 96, which may also take the form of letters, numbers, symbols etc.

The magnetic layer 93 is configured such that its magnetic particles 93*a* display at least one "bright" region 95, preferably in the form of indicia. The bright region includes a significant proportion of flakes which are aligned substantially parallel to the plane of the substrate 91 For instance, the surface planes of the flakes may make an angle of between 60 and 90 degrees, more preferably between 70 and 90 degrees, still preferably between 80 and 90 degrees, most preferably about 90 degrees (e.g. above 89 degrees) with the substrate normal. The bright region 95 can be formed in the layer 93 using any known magnetic orientation technique, preferably that disclosed above with reference to FIGS. 1 to 9. Other imprinting techniques which could be used disclosed, for example, in EP-A-1710756. The layer 93 can also take the form of any of the security elements described in the previous embodiments.

The print layer 92 and magnetic layer 93 are arranged relative to one another such that the bright region 95 displayed by the magnetic layer is aligned with the authorisation data 94. That is, in plan view from above the magnetic layer 93 (viewed along a direction substantially parallel to the security element's normal), the bright region at least partially covers the authorisation data 94. This has the result of concealing at least part of the authorisation data from view, both as a result of the substantially horizontal magnetic flakes 93*a* which form the bright region (and are opaque) obstructing the view of the print layer 92 and due to the high brightness of the region in reflected light, which distracts the user's vision and assists in hiding the underlying print. FIG. 13*b* shows the security element 90 viewed along its normal in reflected light from which it will be seen that, in this example, the bright region 95 takes the form of a circular ring. The data 94, located under ring 95, is not visible. For comparison, this example includes visible printed data items 96*a* and 96*b*, the first of which is not covered by the magnetic layer 93 and the second of which is aligned with a dark region of the magnetic layer 93 in which the magnetic particles are aligned substantially parallel to the normal of the element. The data item 96*a* will be clearly visible in reflected light. The data item 96*b* may also be visible in reflected light depending on the density of the magnetic ink layer since, if the vertical magnetic particles are sufficiently spaced from each other, they will not significantly obstruct a view of the print layer.

FIG. 13*c* shows the same security element 90 viewed in transmission, e.g. by holding the substrate up to a light source. The printed authentication data 95 now becomes visible through the magnetic layer 93 and is revealed as comprising a series of digits "5", arranged to coincide with the location of bright ring 95 in the magnetic layer (represented by a dashed-line circle in FIG. 13*c*). This is achieved by printing the authorisation data 94 at a sufficiently high optical density that the contrast between it and the surrounding translucent substrate is sufficient to be detectable through the magnetic layer when the structure is viewed in transmitted light. The optical density required will therefore depend on the translucence of the substrate and that of the magnetic layer. For example, a magnetic layer containing a high density of magnetic particles will be less translucent and therefore the optical density of the authorisation data will need to be greater. The authorization data should also preferably be printed in a dark colour against a contrasting light coloured substrate to improve its visibility in transmission.

In one example exhibiting the above effects, the printed authorisation data was printed on a light-coloured paper substrate around 100-120 microns thick using a lithographic technique with an ink thickness of around 2 to 4 microns in a dark colour such as black. The printed authorisation data was overprinted with a layer of magnetic ink of the type "Gold to Green" Spark™ ink by Sicpa Holdings S.A, which is a UV-curable ink. The thickness of the magnetic ink layer was around 20 microns but in other examples can range from about 10 microns to about 30 microns. The concentration of the magnetic particles in the ink was around 20% by weight but in other examples can range between around 15% and 25%. The size of the magnetic flakes is around 20 microns in diameter and between 100 nm to 1 micron thick.

The security element 90 therefore provides both covert and overt optical effects. When the element is viewed during normal handling, its visual appearance will be dominated by the bright region of the magnetic layer, which preferably takes the form of indicia. If the authenticity of the element requires further checking, the substrate can be illuminated from the reverse in order to reveal the authorization data. Only if the expected authorization data is indeed present will the validity of the element be confirmed. This type of element therefore provides an additional level of security over and above those already described.

To fully conceal the authorization data, the bright region of the magnetic layer preferably extends laterally beyond the authorization data some distance in all directions. This ensures that the authorization data will remain substantially hidden should the element be viewed in reflection at an oblique angle. To achieve the best effect, the majority of the magnetic particles forming the bright region should preferably be orientated with the reflective surfaces approximately parallel with the plane of the element. However, the particles orientated at an intermediate angle, may also be useful, for instance at each edge of the bright region. These can assist in concealing the authorization data when the element is viewed at an angle. For instance, FIG. 13*a* shows two portions of the magnetic layer, each laterally adjacent to the region of horizontal particles, in which the particles are at a non-zero angle to the substrate. The normals to the planar surfaces of the particles in the "horizontal" region and those in the adjacent portions intersect one another on the substrate side of the magnetic layer. In this way, if the element is tilted, the particles in the two portions are substantially perpendicular to the line of view and prevent viewing of the authorisation data (in reflected light).

FIGS. 14*a* and 14*b* show an example of a security element 80 formed according to the above-described principles. FIG. 14*a* is a view of the element in ambient reflected light, and FIG. 14*b* shows the same element in transmitted light. The element 80 comprises a layer of magnetic ink printed in a "shield" shape on a substrate 81, in this case a banknote. The magnetic layer has a registration feature 83 in the form of a circular gap formed through the layer at its centre. Imprinted in the layer is a bright circular ring 84 which appears 3-dimensional and moves relative to the shield when the element is tilted, formed in this example using the techniques disclosed above with reference to FIGS. 4 to 12. It will be seen that, in reflection, one "rampant lion" FIG. 85 is visible though the magnetic layer in the region inside the bright circle, to the right of registration gap 83. The left hand portion of the shield appears mainly bright, due to the ring 84. In transmitted light, as shown in FIG. 14*b*, the bright ring 84 is no longer visible, the magnetic layer appearing as a flat, dark shadow. The disappearance of the bright ring 84 reveals the presence of printed authorisation data 86 underneath the magnetic layer, in the form of a second lion.

It will be appreciated that both lions 85 and 86 form part of the same print working underneath the magnetic layer 80. Lion 85, however, is aligned with a dark region of the magnetic imprint, in which the magnetic flakes are largely vertical. As such, the lion 85 is visible through the magnetic pigment in reflection. Lion 86 is aligned with a bright portion of the magnetic indicia causing it to be hidden in reflection and revealed in transmission. The bright ring, in this example, is arranged to appear 3-dimensional (as described with reference to previous embodiments) and will also move laterally when the element is tilted. This leads to different portions of the underlying print (lions 85 and 86) becoming visible in reflection as the element is viewed at different angles. This is a particularly effective security feature since the user can test the authenticity of the element by checking that different print elements appear as the element is tilted—for example, the printed data could include a series of number or letters spelling a word, which are revealed in sequence as the element is tilted.

FIG. 15 shows two further examples of security elements 98 and 99 formed according to the same principles as described with reference to FIGS. 13 and 14. In FIG. 15, the elements are shown under reflected light and so the authorization data is not visible. Security element 98 comprises a magnetic layer formed in the shape of a shamrock. In this case, the magnetic layer covers the whole of the print layer and so no printed items are visible apart from a background security print forming part of the base substrate. The magnetic layer 98 displays a bright ring 98*a* imprinted using the methods and apparatus disclosed above with reference to FIGS. 1 to 9. Aligned with the bright ring 98*a*, under the magnetic layer, printed numerals "50" are arranged about a corresponding circle. When viewed in transmitted light, the numerals "50" are revealed. Security element 99 is of a similar construction, the magnetic layer being formed in an approximately annular shape formed of eight adjoining circles which together display the magnetically imprinted bright ring 99*a*. Under each circle of the magnetic layer is hidden the printed number "50", revealed in transmission (the printed data is not visible in FIG. 15 since here the elements are shown under reflected light).

FIG. 16 is a block diagram illustrating steps involved in a method of manufacturing a security element such as those depicted in FIGS. 13, 14 and 15. As noted above, various alternative techniques are possible, including printing the print layer onto a ready-formed magnetic layer (typically after it has been magnetically imprinted and hardened). However, in many cases it is preferred to form the element directly on the substrate which is to carry the element (such as a banknote), and a method such as that shown in FIG. 16 is more suitable for such implementations.

In a first step S000, the print layer is formed by printing authorization data onto a substrate (which may be a document of value or a temporary support substrate, for example). This printing step can be carried out using any printing technique, such as lithographic printing, intaglio, screen printing, flexographic printing, letterpress printing, gravure printing, laser printing or inkjet printing. Preferably the authorization data is printed at a high optical density in a dark colour to contrast with the substrate.

The print layer is then coated or overprinted with the magnetic composition in step S100. This can be carried out in much the same way as discussed with reference to FIGS. 1 and 2 above. The magnetic layer is then imprinted in step S200 to orientate the magnetic or magnetisable particles so as to display at least one bright region aligned with the authorization data. This can be carried out using any technique for applying a magnetic field to the magnetic layer, such as those disclosed in EP-A-1710756. However, in preferred examples, in order to achieve a bright and distinct optical effect, methods and apparatus according to the principles disclosed above with reference to FIGS. 3 to 9 are used to imprint indicia into the layer. The layer may additionally or alternatively be configured to display optical effects such as those described with reference to FIGS. 10 to 12 above. Finally, the oriented particles are fixed by hardening the magnetic layer in step S300. This can be performed as described with reference to FIGS. 1 and 2 above.

FIGS. 17 and 18 show examples of completed products incorporating security elements made in accordance with any of the above embodiments. FIGS. 17*a* and 17*b* show security elements applied to documents of value, such as banknotes. In FIG. 17*a*, the security element 101 simply comprises an elliptical magnetic layer configured to display an indicium in the form of a bright ring 102. The layer is disposed directly on a document of value 100, which may comprise a banknote, passport, identity document, cheque, certificate, licence or similar. The document may typically be provided with other features (not shown) such as security prints, holograms, security threads, micro-optical optically variable structures, and/or security fibres, each of which may provide either a public recognition feature or a machine readable feature or both. These may be added to the document before or after the element 101 is applied. The element 101 may be manufactured directly on the document 100 with no intermediary steps by printing or coating the magnetic composition (and authorization data, if provided) directly onto the document's surface. Alternatively, the security element may initially be manufactured as a transfer element such as a patch, foil or stripe, for later application to the document of value (or indeed any other article), as described below with reference to FIG. 18.

In FIG. 17*b*, the security element 106 displaying, for instance, a bright ring 107, is formed within a transparent window 109 of a document 105. This could be achieved by forming the magnetic layer directly on a transparent polymer banknote substrate such as Guardian™ supplied by Securency Pty Ltd, for example by printing, either before or after the rest of the document is printed or coated in the conventional manner. However, in the present embodiment, the element 106 is formed on a wide tape 108 which is then embedded or applied to a paper substrate forming the document 105. In this case the tape 108 is preferably formed of a transparent polymer such as biaxially oriented polypropylene (BOPP) or PET. The window 109 can be formed by providing a hole in a paper substrate either during formation of the paper or as a conversion process on a finished paper web. The wide polymeric tape can then be applied over the hole, if the tape is transparent an aperture results. The device 106 can be printed on the tape either prior to or post application on the paper substrate. Examples of these types of apertures can be found in U.S. Pat. No. 6,428,051 and US-A-20050224203.

In other preferred implementations, the aperture 109 is formed entirely during the paper making process in accordance with either of the methods described within EP-A-1442171 or EP-A-1141480. For EP-A-1141480 a wide polymer tape 108 is inserted into the paper over a section of the mould cover which has been blinded so no paper fibre deposition can occur. The tape is additionally so wide that no fibres deposit on the rear. In this manner one side of the tape is wholly exposed at one surface of the document in which it is partially embedded, and partially exposed in apertures at the other surface of the substrate. The security device 106 can either be applied to the tape 108 prior to insertion or post insertion. When applied prior to insertion it is preferable, if the feature does not repeat along the length of the tape, to register the area comprising the feature to the aperture in the machine direction. Such a process is not trivial but can be achieved using the process as set out in EP-A-1567714.

The window 109 may be configured such that the element 106 is viewable from both sides of the document, or just one. Methods of incorporating a security device such that it is viewable from both sides of the document are described in EP-A-1141480 and WO-A-3054297. In the method described in EP-A-1141480 one side of the device is wholly exposed at one surface of the document in which it is partially embedded, and partially exposed in apertures at the other surface of the document.

Embodiments such as this, where the element is carried by a transparent portion of the document, are particularly effective in combination with the provision of reference or "datum" features in the form of gaps in the magnetic layer, as described above. The features can be viewed in transmission through the transparent window, causing them to appear in particularly strong contrast with the magnetic optical effect.

It should be noted that, in other embodiments, the window in which the element is visibly need not be transparent. One method for producing paper with so-called windowed threads can be found in EP-A-0059056. EP-A-0860298 and WO-A-03095188 describe different approaches for the embedding of wider partially exposed threads into a paper substrate. Wide threads, typically having a width of 2-6 mm, are particularly useful as the additional exposed thread surface area allows for better use of optically variable devices, such as that disclosed in the present invention. In a development of the windowed thread it is also possible to embed a thread such that it windows alternately on the front and back of a secure document. See EP-A-1567713.

Two further examples of transfer elements are shown in FIG. 18. FIG. 18*a* shows a transfer element 110 in the form of a sticker. The security element (comprising the magnetic layer and any authorization data) is indicated by item 115 and is formed on a support substrate 111 by printing or coating, as before. On the opposite side of the support substrate is provided an adhesive layer 112, such as a contact adhesive or heat-activated adhesive. For storage, the adhesive layer may be mounted on a backing sheet from which the transfer element can be removed when it is to be applied to an article. Multiple elements can be stored on a single backing sheet. FIG. 18*b* shows an alternative transfer element 120 in which the element 125 has been formed by printing or coating onto a support substrate 121 via a release layer 122. An adhesive layer 123 is applied to the opposite side of the element 125. Again, a backing material may be used to cover the adhesive during storage if necessary. For application to an article, the transfer element is placed over the article and a stamp used to apply heat and/or pressure through the support layer 121. The release layer 122 separates the element 125 from the substrate 121 and the adhesive layer bonds the element to the article.

The invention claimed is:

1. A security element comprising a layer disposed on a substrate, the layer comprising a composition having magnetic or magnetisable particles therein, each particle having at least one substantially planar surface, wherein the magnetic or magnetisable particles vary in orientation across the layer such that:

at a first part of the layer, the particles are orientated with their planar surfaces substantially parallel to the normal to the layer, the angle between the planar surfaces of the particles and the normal gradually increasing with increasing distance from the first part to a maximum of approximately 90 degrees at a first position of the layer before decreasing gradually again until a second, father, position of the layer, the normals to the planar surfaces of the particles disposed between the first part and the second position intersecting one another at points on a first side of the layer, and from the second position, the angle between the planar surfaces of the particles and the normal of the layer gradually increases with increasing distance, the normals to the planar surfaces of the particles intersecting one another at points on a second side of the layer, opposite to the first side, such that the security element displays a bright edge corresponding to the first position, between a first dark area which includes the first part of the layer, and a second dark area, at least when the security element is viewed along a direction substantially normal to the plane of the substrate, and wherein when viewed under daylight, the thickness of the bright edge between the contrasting dark areas is less than about 10 mm.

2. A security element according to claim 1, wherein the lateral distance between the first part of the layer and the second position is between 1 and 10 mm.

3. A security element according to claim 1, wherein the rate of change of particle angle with lateral distance is greater between the first part of the layer and the first position, and between the first position and the second positions, than outside the second position.

4. A security element according to claim 1 wherein, in the region of increasing angle between the planar surfaces of the particles and the normal to the layer outside the second position, the angle does not increase to substantially 90 degrees within the periphery of the layer.

5. A security element according to claim 1, wherein in the region of increasing angle between the planar surfaces of the particles and the normal to the layer outside the second position, the angle does not increase to substantially 90 degrees within at least 2 mm of the second position.

6. A security element according to claim 1, wherein the angle between the planar surfaces of the particles and the normal to the layer decreases to an angle of less than 45 degrees at the second position.

7. A security element according to claim 1, wherein the variation of the particles' orientation is substantially the same along each direction such that the bright edge forms a circular outline, the first dark area being located within the outline and the second dark area being located outside the outline.

8. A security element according to claim 1, wherein the variation of the particles' orientation along each direction is a function of angular position, such that the bright edge forms a non-circular outline, the first dark area being located within the outline and the second dark area being located outside the outline.

9. A security element according to claim 1, wherein along selected direction(s) the particle orientation does not undergo any variation, remaining substantially parallel to the normal of the substrate, to thereby form one or more corresponding gaps in the bright edge.

10. A security element according to claim 1, wherein when the angle of viewing is changed, the bright edge appears to move laterally, relative to the layer.

11. A security element according to claim 1, wherein the layer is provided with one or more registration features against which the position of the bright edge may be judged.

12. A security element according to claim 1, wherein the magnetic or magnetisable particles have an elongate shape.

13. A security element according to claim 1, wherein the magnetic or magnetisable particles comprise an optically variable structure whereby the particles reflect light having wavelengths within a first spectral band at a first angle of incidence, and light having wavelengths within a second, different spectral band at a second angle of incidence.

14. A security element according to claim 13, wherein a region of the layer outside the second radial position exhibits, at certain viewing angles, a first portion of a first color and a second portion of a second color, the boundary between the first and second portions appearing to move as the viewing angle is altered.

15. A security element according to claim 1, wherein, when viewed under multiple light sources, multiple bright edges of matching shape, displaced from one another, are displayed.

16. An insert for a security document comprising a security element according to claim 1.

17. A transfer element comprising a security element according to claim 1, disposed on a support substrate.

18. A transfer element according to claim 17, further comprising an adhesive layer for adhering the security element to an article.

19. A transfer element according to claim 17, further comprising a release layer between the security element and the support substrate.

20. A transfer element according to claim 17, wherein the transfer element is a thread, tape, foil or patch.

21. A document of value comprising a security element according to claim 1.

* * * * *